US007462021B2

(12) United States Patent
Ebara et al.

(10) Patent No.: US 7,462,021 B2
(45) Date of Patent: Dec. 9, 2008

(54) ROTARY COMPRESSOR, AND CAR AIR CONDITIONER AND HEAT PUMP TYPE WATER HEATER USING THE COMPRESSOR

(75) Inventors: Toshiyuki Ebara, Gunma (JP); Hiroyuki Matsumori, Gunma (JP); Takashi Sato, Saitama (JP); Dai Matsuura, Gunma (JP); Takayasu Saito, Saitama (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 660 days.

(21) Appl. No.: 10/945,925

(22) Filed: Sep. 22, 2004

(65) Prior Publication Data

US 2005/0069423 A1 Mar. 31, 2005

(30) Foreign Application Priority Data

| | | |
|---|---|---|
| Sep. 30, 2003 | (JP) | 2003-342461 |
| Oct. 10, 2003 | (JP) | 2003-352566 |
| Nov. 5, 2003 | (JP) | 2003-376064 |
| Nov. 18, 2003 | (JP) | 2003-387349 |

(51) Int. Cl.
*F03C 2/00* (2006.01)
*F04C 2/00* (2006.01)

(52) U.S. Cl. ..... 418/60; 418/11; 418/89; 418/97; 418/100; 418/DIG. 1; 184/6.16; 184/6.18

(58) Field of Classification Search ..... 418/60, 418/63, 83, 86, 89, 97, 100, DIG. 1, 201.1, 418/181; 184/6.16–6.18; 417/410.5, 902
See application file for complete search history.

(56) References Cited

U.S. PATENT DOCUMENTS

| | | | | |
|---|---|---|---|---|
| 3,250,459 A | * | 5/1966 | Brown et al. | 418/97 |
| 3,558,248 A | | 1/1971 | Parker | |
| 4,545,747 A | * | 10/1985 | Tamura et al. | 418/98 |
| 4,640,669 A | | 2/1987 | Gannaway | |
| 4,755,114 A | * | 7/1988 | Shibayashi et al. | 418/DIG. 1 |
| 6,082,981 A | * | 7/2000 | Nakajima et al. | 418/55.6 |

(Continued)

FOREIGN PATENT DOCUMENTS

DE 41 37 363 A1 12/1992

(Continued)

OTHER PUBLICATIONS

European Search Report dated Nov. 25, 2005, issued in corresponding European Application No. 04021471.0-2315.

(Continued)

*Primary Examiner*—Theresa Trieu
(74) *Attorney, Agent, or Firm*—Westerman, Hattori, Daniels & Adrian, LLP.

(57) ABSTRACT

An object is to provide a rotary compressor capable of reducing an oil discharge amount to the outside, and there is provided a vertical rotary compressor constituted by housing an electromotive element and a rotary compression mechanism section driven by the electromotive element in an airtight container, wherein an oil separation mechanism for centrifugally separating oil in a refrigerant which has been compressed by the rotary compression mechanism section and discharged is disposed in a space between the airtight container and the rotary compression mechanism section in the airtight container.

5 Claims, 18 Drawing Sheets

U.S. PATENT DOCUMENTS

| | | | | |
|---|---|---|---|---|
| 6,227,831 | B1 * | 5/2001 | Osima et al. | 418/DIG. 1 |
| 6,309,198 | B1 | 10/2001 | Zamudio et al. | |
| 2002/0047126 | A1 | 4/2002 | Zamudio et al. | |
| 2002/0067998 | A1 | 6/2002 | Narney, II et al. | |

FOREIGN PATENT DOCUMENTS

| | | | | |
|---|---|---|---|---|
| EP | 63-162991 | | 7/1988 | |
| EP | 1 209 357 | A1 | 5/2002 | |
| EP | 1 284 366 | A1 | 2/2003 | |
| EP | 1 316 730 | A2 | 6/2003 | |
| JP | 02-294587 | | 12/1990 | |
| JP | 06026484 | A * | 2/1994 | 418/55.6 |
| JP | 2507047 | | 4/1996 | |
| JP | 10-141270 | | 5/1998 | |
| JP | 2000-105004 | | 4/2000 | |
| JP | 2000-105005 | | 4/2000 | |
| JP | 2003-074997 | | 3/2003 | |

OTHER PUBLICATIONS

Patent Abstracts of Japan, vol. 017, No. 584 (M-1501), Oct. 25, 1993 & JP 05 172076, Jul. 9, 1993.

* cited by examiner

ROTARY COMPRESSOR, AND CAR AIR CONDITIONER AND HEAT PUMP TYPE WATER HEATER USING THE COMPRESSOR

BACKGROUND OF THE INVENTION

The present invention relates to a rotary compressor constituted by housing a driving element and a rotary compression mechanism section driven by the driving element in an airtight container, and a car air conditioner and a heat pump type water heater using the rotary compressor.

This type of rotary compressor has heretofore been, for example, an internal intermediate pressure type multistage (two-stage) compression system rotary compressor including first and second rotary compression elements, and the compressor is constituted of a driving element and a rotary compression mechanism section driven by the driving element in an airtight container.

Moreover, a refrigerant gas is drawn in a cylinder on the side of a low pressure chamber via a suction port of the first rotary compression element, compressed by an operation of a roller and a vane to obtain an intermediate pressure, and discharged into the airtight container from the side of a high pressure chamber of the cylinder via a discharge port and a discharge noise silencing chamber. Moreover, the refrigerant gas having the intermediate pressure in the airtight container is drawn in the cylinder on the side of the low pressure chamber from a suction port of the second rotary compression element, compressed by the operation of the roller and vane in a second stage to constitute a high-temperature/pressure refrigerant gas, and discharged to the outside of the compressor from the side of the high pressure chamber via the discharge port and discharge noise silencing chamber.

Moreover, a bottom portion in the airtight container is constituted as an oil reservoir, and oil is pumped up from the oil reservoir by an oil pump (oil supply means) attached to one end (lower end) of a rotation shaft, and supplied to a sliding portion of the rotary compression mechanism section to lubricate and seal the portion (see, for example, Japanese Patent No. 2507047, and Japanese Patent Application Laid-Open Nos. 2-294587, 2000-105004, 2000-105005, 2003-74997, and 10-141270).

However, the oil mixed in the refrigerant gas compressed by the first rotary compression element as described above is discharged into the airtight container, and separated from the refrigerant gas to a certain degree in the process of movement in a space in the airtight container. However, the oil mixed in the refrigerant gas compressed by the second rotary compression element is discharged as such to the outside of the compressor together with the refrigerant gas.

Therefore, there has been a problem that the oil in the oil reservoir runs short and that a sliding performance or sealing property lowers. There has also been a possibility that a trouble is caused in refrigerant circulation in a refrigerant circuit, or the refrigerant circuit is adversely affected otherwise by the oil discharged to the outside of the compressor.

Moreover, an oil separator is connected to a piping outside the airtight container to separate the oil from the discharged refrigerant gas, and the oil is devised to be returned to the compressor in this manner, but there has been a problem that an installation space enlarges.

SUMMARY OF THE INVENTION

According to the present invention, there is provided a vertical rotary compressor constituted by housing a driving element and a rotary compression mechanism section driven by the driving element in an airtight container, the compressor comprising: oil separation means, disposed in the airtight container, for centrifugally separating oil in a refrigerant which has been compressed by the rotary compression mechanism section and discharged.

Moreover, according to the present invention, in the above-described invention, the oil separation means is disposed in the vicinity of the rotary compression mechanism section in a space between the airtight container and the rotary compression mechanism section.

Furthermore, according to the present invention, there is provided a rotary compressor constituted by comprising a driving element and a rotary compression element driven by the driving element in an airtight container, the compressor comprising: a cylinder constituting the rotary compression element; a support member which blocks an opening surface of the cylinder; a discharge noise silencing chamber formed in the support member to communicate with the inside of the cylinder; and a cover attached to the support member to block an opening of the discharge noise silencing chamber on a side opposite to the cylinder, wherein a discharge passage for discharging a refrigerant discharged into the discharge noise silencing chamber from the cylinder to the outside of the airtight container is formed in the cover.

Additionally, in the rotary compressor of the present invention, additionally, a cover side discharge noise silencing space which communicates with the discharge noise silencing chamber is formed in the cover.

Moreover, in the rotary compressor of the present invention, additionally, the discharge passage is connected to the discharge noise silencing chamber in a state in which the discharge passage is partitioned from the cover side discharge noise silencing space.

Furthermore, according to the present invention, there is provided a rotary compressor comprising: a rotary compression mechanism section constituted of first and second stage compression elements in such a manner that a discharged gas from the first stage compression element is drawn in the second stage compression element; an electric motor which drives the rotary compression mechanism section; an airtight container in which the electric motor and the rotary compression mechanism section are housed and which is filled with a discharged gas refrigerant of the first stage compression element; an oil reservoir portion formed in a bottom part of the airtight container; and an oil supply passage including one end opened in a space portion which is an oil passage formed in an outer periphery of a rotation shaft of the electric motor, and the other end opened in an in-cylinder space portion formed between a compression step end point and a suction step start point in a cylinder wall of the second stage compression element.

Additionally, according to the present invention, there is provided a rotary compressor comprising: a rotary compression mechanism section constituted of a low stage side compression element and a high stage side compression element in such a manner that a discharged gas from the low stage side compression element is drawn in the high stage side compression element; an electric motor which drives the rotary compression mechanism section; an airtight container in which the electric motor and the rotary compression mechanism section are housed and which is filled with a discharged gas refrigerant of the low stage side compression element; and a pressure control valve housed in a housing constituting the rotary compression mechanism section, wherein the pressure control valve is constituted to introduce the gas refrigerant in the airtight container into a cylinder of the high stage side compression element, when a discharge pressure of the low stage side compression element lowers to a predetermined value or less and to interrupt the introducing of the gas refrigerant in the airtight container into the cylinder, when the discharge pressure of the low stage side compression element exceeds the predetermined value and rises.

Moreover, the pressure control valve comprises: a piston; and a cylinder in which the piston is slidably housed. Furthermore, a resultant force of a low pressure side pressure and an elastic force of a spring, and a gas refrigerant pressure in the airtight container are applied in a facing manner to the piston, the piston is moved in one direction in the cylinder by the resultant force in such a manner as to be capable of introducing the gas refrigerant in the airtight container into the cylinder of the high stage side compression element, when the discharge pressure of the low stage side compression element lowers to the predetermined value or less, and the piston is moved in the other direction by the gas refrigerant pressure in the airtight container against the resultant force to interrupt the introducing of the gas refrigerant in the airtight container into the cylinder, when the discharge pressure of the low stage side compression element exceeds the predetermined value and rises.

Furthermore, according to the present invention, there is provided a car air conditioner comprising: the above-described rotary compressor, wherein a carbon dioxide gas is used as a refrigerant.

Additionally, according to the present invention, there is provided a heat pump type water heater comprising: the above-described rotary compressor, wherein a carbon dioxide gas is used as a refrigerant.

DETAILED DESCRIPTION OF THE PREFERRED EMBODIMENT

Figure 1:
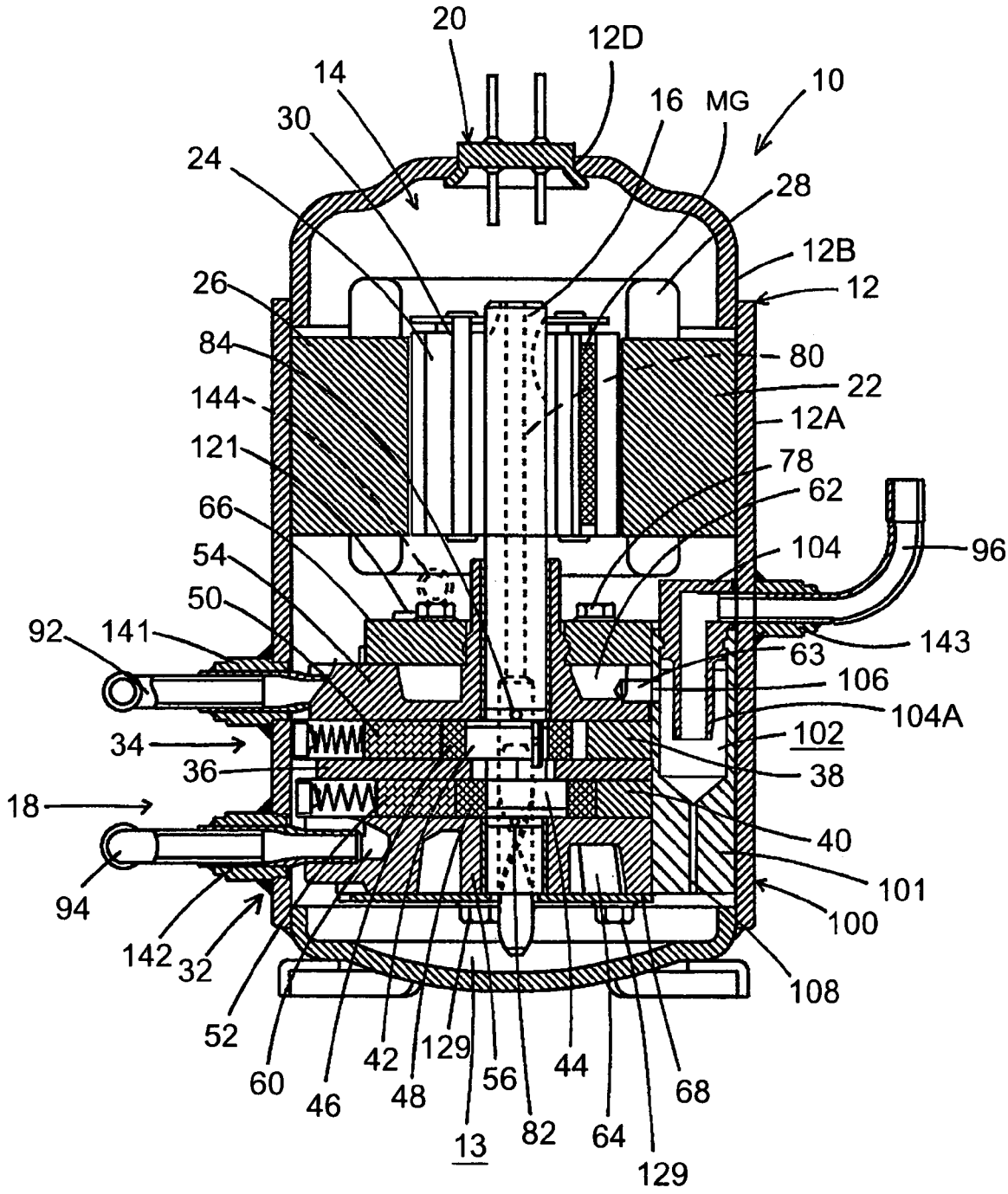
FIG. 1 is a vertical sectional view of a vertical rotary compressor according to one embodiment of the present invention.

FIG. 1 shows a vertical rotary compressor of one embodiment of the present invention, and shows a vertical sectional view of a rotary compressor 10 of an internal intermediate pressure type multistage (two-stage) compression system, including first and second rotary compression elements 32, 34.

In FIG. 1, reference numeral 10 denotes a vertical rotary compressor of the internal intermediate pressure type multistage compression system. The rotary compressor 10 is constituted of: a vertical and cylindrical airtight container 12 formed of a steel plate; an electromotive element 14 which is a driving element disposed/housed above an inner space of the airtight container 12; and a rotary compression mechanism section 18 disposed under the electromotive element 14 and constituted of a first rotary compression element 32 (first stage) and a second rotary compression element 34 (second stage) driven by a rotation shaft 16 of the electromotive element 14.

A bottom part of the airtight container 12 is constituted as an oil reservoir 13, and the airtight container is constituted of a container main body 12A in which the electromotive element 14 and the rotary compression mechanism section 18 are housed, and a substantially bowl-shaped end cap (lid body) 12B which blocks an upper opening of the container main body 12A. Moreover, a circular attaching hole 12D is formed in a center of the upper surface of the end cap 12B, and a terminal (wiring is omitted) 20 for supplying a power to the electromotive element 14 is attached to the attaching hole 12D.

The electromotive element 14 is constituted of a stator 22 attached in an annular shape along an inner peripheral surface of an upper space of the airtight container 12, and a rotor 24 inserted/disposed inside the stator 22 with a slight gap. The rotor 24 is fixed to the rotation shaft 16 passing through a center and extending in a perpendicular direction.

The stator 22 includes a stacked member 26 in which donut-shaped electromagnetic steel plates are stacked upon one another, and a stator coil 28 wound around a teeth portion of the stacked member 26 by a direct winding (concentrated winding) system. Moreover, the rotor 24 is also formed of a stacked member 30 of electromagnetic steel plates in the same manner as in the stator 22, and a permanent magnet MG is inserted/constituted in the stacked member 30.

The rotary compression mechanism section 18 is constituted of: upper and lower cylinders 38, 40 constituting the first and second rotary compression elements 32, 34; upper and lower rollers 46, 48 fitted in upper and lower eccentric portions 42, 44 disposed in the upper and lower cylinders 38, 40, respectively, to eccentrically rotate; an intermediate partition plate 36 disposed between the upper and lower cylinders 38, 40, and the rollers 46, 48 to partition the first and second rotary compression elements 32, 34 from each other; vanes 50, 52 which abut on rollers 46, 48 to divide the insides of the upper and lower cylinders 38, 40 into low and high pressure chamber sides; and an upper support member 54 and a lower support member 56 which are support members for blocking an upper opening surface of the upper cylinder 38 and a lower opening surface of the lower cylinder 40 to also serve as bearings of the rotation shaft 16.

The upper support member 54 and the lower support member 56 are provided with: suction passages 60 (upper suction passage is not shown) which communicate with the insides of the upper and lower cylinders 38, 40 via suction ports (not shown), respectively; and discharge noise silencing chambers 62, 64 which are partially dented in concave shapes and whose concave portions are blocked and formed by an upper cover 66 and a lower cover 68.

In this case, a peripheral portion of the lower cover 68 is fixed to the lower support member 56 from below by main bolts 129 . . . Tips of the main bolts 129 . . . engage with the upper support member 54.

It is to be noted that the discharge noise silencing chamber 64 of the first rotary compression element 32 communicates with the inside of the airtight container 12 via a communication path. This communication path is constituted of a hole (not shown) extending through the lower support member 56, upper support member 54, upper cover 66, upper and lower cylinders 38, 40, and intermediate partition plate 36. In this case, an intermediate discharge tube 121 is vertically disposed on an upper end of the communication path, and a refrigerant having an intermediate pressure is discharged into the airtight container 12 via the intermediate discharge tube 121.

Moreover, the electromotive element 14 is disposed above the upper cover 66 in the airtight container 12 at a predetermined interval. A peripheral portion of the upper cover 66 is fixed to the upper support member 54 from above via main bolts 78 . . . Tips of the main bolts 78 . . . engage with the lower support member 56.

On the other hand, an oil hole 80 in a vertical direction, and oil supply holes 82, 84 (formed also in the upper and lower eccentric portions 42, 44) in a transverse direction, which communicate with the oil hole 80, are formed in an axial center in the rotation shaft 16, and oil is supplied to sliding portions of the rotary compression mechanism section 18 from the holes.

Moreover, in this case, existing oils such as mineral oil, polyalkylene glycol (PAG), alkyl benzene oil, ether oil, and ester oil are used as oils which are lubricants.

On the side surface of the container main body 12A of the airtight container 12, sleeves 141, 142, 143, and 144 are welded/fixed to positions corresponding to the suction passages 60 (the upper suction passage is not shown) of the upper support member 54 and lower support member 56 and upper side (position substantially corresponding to the lower end of the electromotive element 14) of the upper cover 66. The sleeve 141 is vertically adjacent to the sleeve 142, and the sleeve 143 is disposed in a position deviating from that of the sleeve 144 by approximately 90 degrees.

Moreover, one end of a refrigerant introducing tube 92 for introducing the refrigerant gas into the upper cylinder 38 is inserted/connected into the sleeve 141, and one end of the refrigerant introducing tube 92 communicates with a suction passage (not shown) of the upper cylinder 38. The refrigerant introducing tube 92 passes through an upper part of the airtight container 12 to reach the sleeve 144, and the other end thereof is inserted/connected into the sleeve 144 to communicate with the inside of the airtight container 12.

One end of a refrigerant introducing tube 94 for introducing the refrigerant gas into the lower cylinder 40 is inserted/connected into the sleeve 142, and one end of the refrigerant introducing tube 94 communicates with the suction passages 60 of the lower cylinder 40. A refrigerant discharge tube 96 is inserted/connected into the sleeve 143, and one end of the refrigerant discharge tube 96 is connected to an oil separation mechanism 100 which is oil separation means described later.

The oil separation mechanism 100 for separating oil in discharged refrigerant compressed by the second rotary compression element 34 is disposed in a gap (space) formed between the rotary compression mechanism section 18 and the inner peripheral surface of the airtight container 12 in the vicinity of the rotary compression mechanism section 18 in the airtight container 12.

Figure 2:
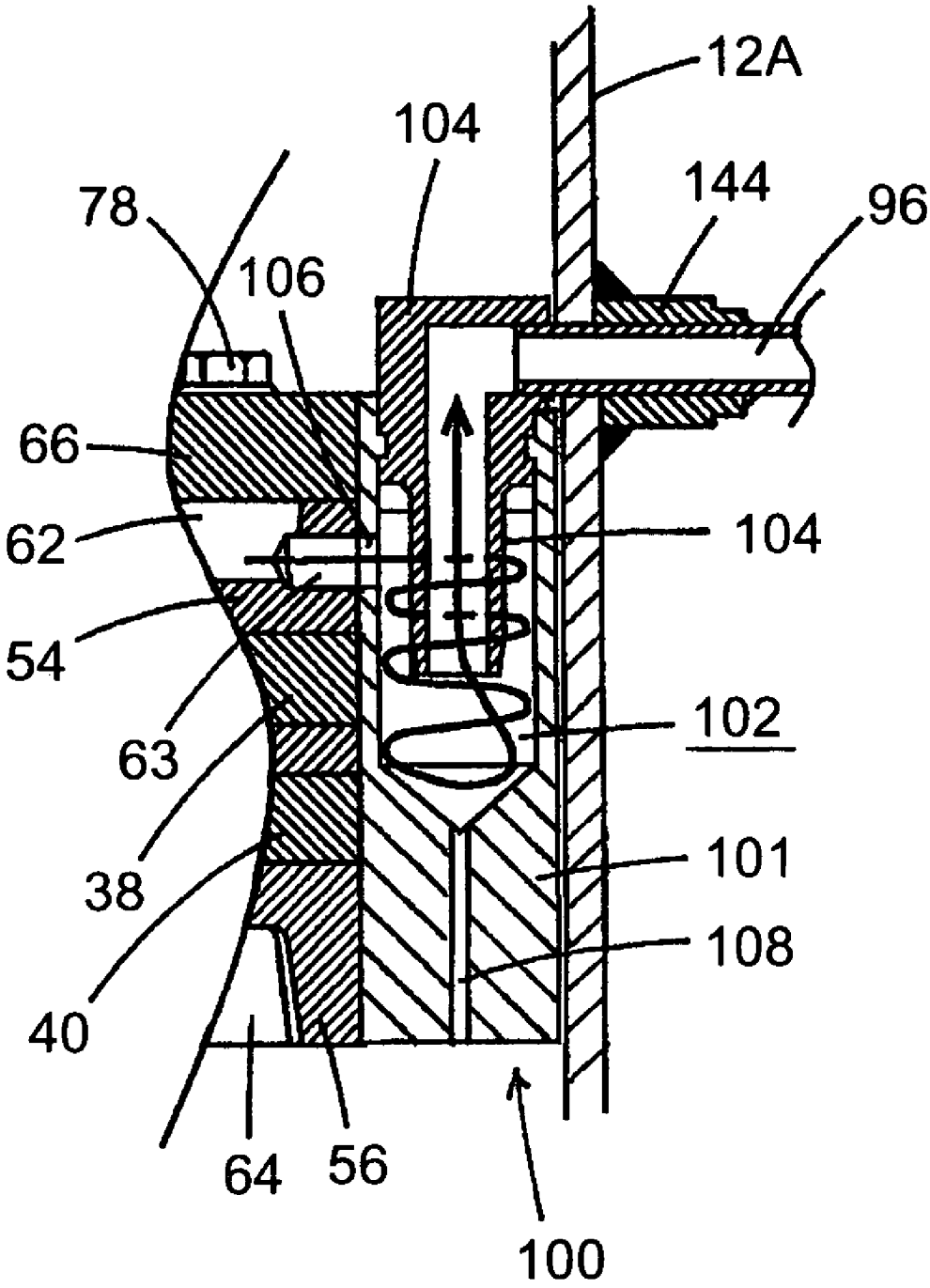
FIG. 2 is a diagram showing a flow of a refrigerant gas in an oil separation mechanism of the rotary compressor of FIG. 1.

Here, the oil separation mechanism 100 will be described with reference to FIG. 2. That is, the oil separation mechanism 100 is constituted of: a main body 101; a space portion 102 which is formed into a vertically long cylindrical shape in the main body 101 and whose upper surface opens; a communication tube 104 which blocks an opening in the upper surface of the space portion 102; a communication hole 106 which connects the discharge noise silencing chamber 62 of the second rotary compression element 34 to the space portion 102 of the oil separation mechanism 100 via a communication path 63 formed in the upper support member 54; and a fine hole 108 formed in the space portion 102 on a lower side.

The communication tube 104 is formed in a size substantially equal to an inner diameter of the space portion 102, and is inserted/connected via an opening in the upper surface of the space portion 102. A tip portion 104A (lower end) of the communication tube 104 is formed in a predetermined length and a piping thickness smaller than that of another portion, and the tip portion 104A opens downwards in the space portion 102. A gap is formed between the space portion 102 and the tip portion 104A of the communication tube 104. The communication hole 106 is formed in a position substantially corresponding to an upper end of the tip portion 104A of the communication tube 104 in such a manner that the refrigerant from the discharge noise silencing chamber 62 is discharged toward the outer wall surface of the tip portion 104A of the communication tube 104 from the communication hole 106 via the communication path 63. It is to be noted that the refrigerant discharge tube 96 is inserted/connected into another opening formed in an upper portion of the communication tube 104.

Moreover, the lower end of the space portion 102 has a substantially conical shape gradually thinned toward the fine hole 108, and the lower end of the fine hole 108 opens toward the oil reservoir 13 formed in the bottom part of the airtight container 12.

Furthermore, the oil separation mechanism 100 is screwed/fixed toward the rotation shaft 16 from the airtight container 12 by screws (not shown), and accordingly attached to the outer surface of the upper support member 54.

Next, an operation of the above-described constitution will be described. When the stator coil 28 of the electromotive element 14 is excited via the terminal 20 and a wiring (not shown), the electromotive element 14 starts, and the rotor 24 rotates. By the rotation, the upper and lower rollers 46, 48 fitted into the upper and lower eccentric portions 42, 44 disposed integrally with the rotation shaft 16 eccentrically rotate in the upper and lower cylinders 38, 40 as described above.

Accordingly, a low-pressure refrigerant gas drawn in the lower cylinder 40 on the side of a low pressure chamber from a suction port (not shown) via the refrigerant introducing tube 94 and the suction passage 60 formed in the lower support member 56 is compressed by the operation of the roller 48 and vane 52 to obtain an intermediate pressure. The gas is discharged into the airtight container 12 from the intermediate discharge tube 121 via a discharge port (not shown) from the lower cylinder 40 on the side of a high pressure chamber and a communication path (not shown) from the discharge noise silencing chamber 64 formed in the lower support member 56. Accordingly, the inside of the airtight container 12 attains the intermediate pressure.

Moreover, the refrigerant gas having the intermediate pressure in the airtight container 12 flows out of the sleeve 144, and is drawn in the upper cylinder 38 on the side of the low pressure chamber from the suction port (not shown) via the refrigerant introducing tube 92 and a suction passage 58 formed in the upper support member 54. The drawn-in refrigerant gas having the intermediate pressure is compressed in a second stage by the operation of the roller 46 and vane 50 to constitute a high-temperature/pressure refrigerant gas. The gas passes through a discharge port (not shown) from the side of the high pressure chamber, and is discharged into the discharge noise silencing chamber 62 formed in the upper support member 54. The refrigerant discharged in the discharge noise silencing chamber 62 is discharged into the space portion 102 from the communication hole 106 of the oil separation mechanism 100 via the communication path 63. At this time, the refrigerant gas and the oil mixed in the refrigerant gas are discharged toward the outer wall surface of the tip portion 104A of the communication tube 104 in the space portion 102 from the communication hole 106 as shown by an arrow in FIG. 2. The discharged refrigerant gas and oil turn around in a spiral form in a gap formed between the outer wall surface of the tip portion 104A and the inner peripheral surface of the space portion 102, and flow downwards in the space portion 102 by momentum at the time of the discharging.

In this process, the oil mixed in the refrigerant gas is centrifugally separated from the refrigerant gas, and attached to the outer wall surface of the space portion 102 and the like. The oil flows along the outer wall surface, reaches the fine hole 108 formed under the space portion 102, and is returned to the oil reservoir in the lower part of the airtight container 12.

When the oil mixed in the refrigerant gas compressed by the second rotary compression element 34 is centrifugally separated by the oil separation mechanism 100, the oil mixed in the refrigerant gas can be effectively separated.

Accordingly, since an oil discharge amount from the compressor 10 can be remarkably reduced, it is possible to avoid beforehand a disadvantage that the oil runs short in the compressor 10 or that the inside of the refrigerant circuit is adversely affected.

Moreover, since the oil separation mechanism 100 is disposed in the space between the airtight container 12 and the rotary compression mechanism section 18, the compressor 10 can be prevented from being enlarged by the disposed oil separation mechanism 100.

Furthermore, since the oil separation mechanism 100 is disposed in the airtight container 12 of the rotary compressor 10, the refrigerant circuit including the compressor 10 can be prevented from being enlarged, and this can contribute to miniaturization of an apparatus.

Additionally, the oil separation mechanism 100 is attached to the outer surface of the upper support member 54 in which the discharge noise silencing chamber 62 of the second rotary compression element 34 is formed, and accordingly a path via which the refrigerant compressed by the second rotary compression element 34 and discharged into the discharge noise silencing chamber 62 enters the oil separation mechanism 100 can be minimized. Design changes of the rotary compressor 10 can be minimized. Accordingly, an increase of a production cost can be suppressed to the utmost.

It is to be noted that in the present embodiment, the vertical rotary compressor has been described in accordance with the vertical rotary compressor of the two-stage compression system including the first and second rotary compression elements 32, 34. However, the present invention is not limited to this embodiment. Application even to a vertical rotary compressor including a single cylinder as in claim 1, an internal high pressure type rotary compressor, or a multistage compression system rotary compressor including three, four, or more stages of rotary compression elements is effective. The invention according to claim 3 may be applied to an internal intermediate pressure vertical rotary compressor including two or more stages of rotary compression elements.

Moreover, in the present embodiment, the oil separated by the oil separation mechanism 100 is returned to the oil reservoir in the airtight container 12, but the present invention is not limited to this embodiment, and the oil may be returned to a sliding portion of the rotary compression mechanism section 18.

As described above in detail, according to the present invention, the oil separation means for centrifugally separating the oil in the refrigerant compressed and discharged by the rotary compression mechanism section is disposed in the airtight container. Therefore, the rotary compressor can be prevented from being enlarged, and an amount of oil discharged to the outside of the rotary compressor can be remarkably reduced.

Therefore, the refrigerant circuit including the rotary compressor can be prevented from being enlarged, and this can contribute to miniaturization of the apparatus. A total length of the rotary compressor can be prevented from being enlarged by the disposed oil separation means. Especially, since the oil separation means is disposed in the vicinity of the rotary compression mechanism section in the airtight container, the path for guiding the refrigerant compressed by the rotary compression mechanism section into the oil separation means can be reduced, and design changes of the rotary compressor can be minimized.

Figure 3:
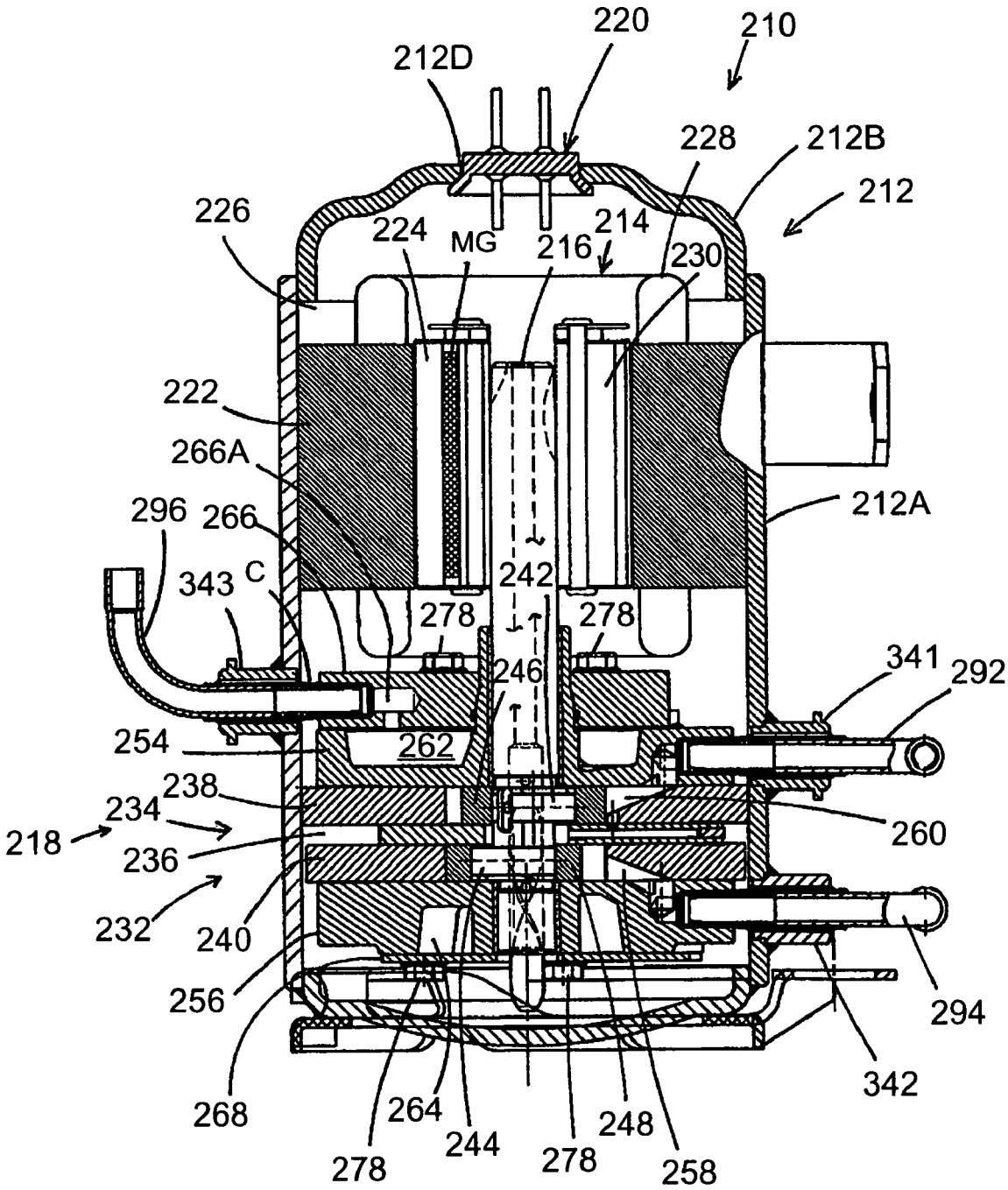
FIG. 3 is a vertical side view of an internal intermediate pressure type multistage (two-stage) compression system rotary compressor including first and second rotary compression elements as an embodiment of another rotary compressor of the present invention.

Next, another embodiment of the present invention will be described in detail with reference to FIGS. 3 to 7. FIG. 3 is a vertical side sectional view of an internal intermediate pressure type multistage (two-stage) compression system rotary compressor 210 including first and second rotary compression elements 232, 234 in accordance with then embodiment of the rotary compressor of the present invention.

In the figure, reference numeral 210 denotes an internal intermediate pressure type multistage compression system rotary compressor in which carbon dioxide ($CO_2$) is used as a refrigerant. The multistage compression system rotary compressor 210 is constituted of: a cylindrical airtight container 212 formed of a steel plate; a driving element 214 disposed/housed on an upper side of an inner space of the airtight container 212; and a rotary compression mechanism section 218 disposed under the driving element 214 and constituted of a first rotary compression element 232 (first stage) and a second rotary compression element 234 (second stage) driven by a rotation shaft 216 of the driving element 214.

A bottom part of the airtight container 212 is constituted as an oil reservoir, and the airtight container is constituted of a container main body 212A in which the driving element 214 and the rotary compression mechanism section 218 are housed, and a substantially bowl-shaped end cap (lid body) 212B which blocks an upper opening of the container main body 212A. A circular attaching hole 212D is formed in a center of the upper surface of the end cap 212B, and a terminal (wiring is omitted) 220 for supplying a power to the driving element 214 is attached to the attaching hole 212D.

The driving element 214 is constituted of a stator 222 attached in an annular shape along an inner peripheral surface of an upper space of the airtight container 212, and a rotor 224 inserted/disposed inside the stator 222 with a slight gap. The rotor 224 is fixed to the rotation shaft 216 passing through the center and extending in a perpendicular direction.

The stator 222 includes a stacked member 226 in which donut-shaped electromagnetic steel plates are stacked upon one another, and a stator coil 228 wound around a teeth portion of the stacked member 226 by a direct winding (concentrated winding) system. The rotor 224 is also formed of a stacked member 230 of electromagnetic steel plates in the same manner as in the stator 222, and a permanent magnet MG is buried/constituted in the stacked member 230.

An intermediate partition plate 236 is held between the first rotary compression element 232 and the second rotary compression element 234. That is, the first rotary compression element 232 and the second rotary compression element 234 of the rotary compression mechanism section 218 are constituted of: the intermediate partition plate 236; an upper cylinder 238 and a lower cylinder 240 disposed on/under the intermediate partition plate 236; upper and lower rollers 246, 248 fitted into upper and lower eccentric portions 242, 244 disposed on the rotation shaft 216 with a phase difference of 180 degrees to eccentrically rotate in the upper and lower cylinders 238, 240; upper and lower vanes (not shown) which are urged by a spring (not shown) and a back pressure and whose tips abut on the upper and lower rollers 246, 248 and which divide the insides of the upper and lower cylinders 238, 240 into low and high pressure chamber sides; and an upper support member 254 and a lower support member 256 which are support members for blocking an upper opening surface of the cylinder 238 and a lower opening surface of the cylinder 240 and for serving also as bearings of the rotation shaft 216.

The upper support member 254 and the lower support member 256 are provided with: suction passages 258, 260 which communicate with the insides of the upper and lower cylinders 238, 240 via suction ports (not shown); and discharge noise silencing chambers 262, 264 formed of concave portions 254A (the portion on the side of the lower support member 256 is not shown) which are partially dented as described later and which are blocked by an upper cover 266 and a lower cover 268. The upper support member 254 is formed into a shape extending along the inner periphery of the cylindrical airtight container 212, and is partially cut out in such a manner that oil supplied on the side of the driving element 214 flows downstream as a lubricant. The insides of the airtight container 212 on/under the upper support member 254 communicate with each other.

Here, to constitute the first and second rotary compression elements 232, 234, the upper support member 254, second rotary compression element 234, intermediate partition plate 236, first rotary compression element 232, and lower support member 256 are arranged in order, and integrally fixed together with the upper cover 266 and lower cover 268 by a plurality of fastening bolts 278. That is, the peripheries of the first and second rotary compression elements 232, 234 are fixed from the side of the upper cover 266 of the upper support member 254 by the plurality of fastening bolts 278. The fastening bolts 278 are fixed to four peripheral places of the rotation shaft 216 at a predetermined interval.

It is to be noted that the discharge noise silencing chamber 264 communicates with the airtight container 212 via a communication path (not shown) extending through the upper and lower cylinders 238, 240 and the intermediate partition plate 236. An intermediate discharge tube (not shown) is vertically disposed on an upper end of the communication path, and a refrigerant having an intermediate pressure compressed by the first rotary compression element 232 is discharged into the airtight container 212 from the intermediate discharge tube.

Moreover, even in this case, carbon dioxide ($CO_2$) described above, which is an ecologically friendly natural refrigerant, is used as the refrigerant in consideration of flammability, toxicity and the like, and existing oils such as mineral oil, alkyl benzene oil, ether oil, ester oil, and polyalkylene glycol (PAG) are used as oils which are lubricants.

On the side surface of the container main body 212A of the airtight container 212, sleeves 341, 342, and 343 are welded/fixed to positions corresponding to the suction passages 258, 260 of the upper support member 254 and lower support member 256 and the side surface of the upper cover 266. A sleeve (not shown) is welded/fixed to a position corresponding to the upper side of the upper cover 266 (a position substantially corresponding to the lower end of the driving element 214 in this case).

Moreover, one end (in actual, a collar) of a refrigerant introducing tube 292 for introducing the refrigerant gas into the upper cylinder 238 is inserted/connected into the sleeve 341, and one end of the refrigerant introducing tube 292 communicates with the suction passage 260 of the cylinder 238. The refrigerant introducing tube 292 passes through an upper part of the airtight container 212 to reach the sleeve (not shown) disposed in the position substantially corresponding to the lower end of the driving element 214, and the other end thereof is inserted/connected into the sleeve to communicate with the inside of the airtight container 212.

Furthermore, one end (actually a collar) of a refrigerant introducing tube 294 for introducing the refrigerant gas into the lower cylinder 240 is inserted/connected into the sleeve 342, and one end of the refrigerant introducing tube 294 communicates with the suction passage 258 of the cylinder 240.

A discharge passage 266A opened in a position corresponding to the sleeve 343 and communicating with the inside of the discharge noise silencing chamber 262 is formed in the upper cover 266. This upper cover 266 is constituted in such a thickness that a collar C communicating with a refrigerant discharge tube 296 inserted from the sleeve 343 is fitted/inserted and is connectable, and the discharge passage 266A is formed by carving a hole within a thickness of the upper cover 266. That is, the discharge passage 266A extending toward the rotation shaft 216 from the side of the sleeve 343, bending downwards, and extending to the discharge noise silencing chamber 262 is formed in the upper cover 266.

Moreover, the refrigerant discharge tube 296 is inserted/connected into the sleeve 343, and one end of the refrigerant discharge tube 296 extends through the discharge passage 266A formed in the upper cover 266 via the collar C to communicate with the inside of the discharge noise silencing chamber 262. That is, the collar C does not pass through the upper support member 254 as in a conventional collar, and passes through the discharge passage 266A formed in the upper cover 266 and opens into the discharge noise silencing chamber 262 to connect the refrigerant discharge tube 296 to the discharge noise silencing chamber 262. Moreover, the refrigerant discharged into the discharge noise silencing chamber 262 from the upper cylinder 238 flows through the sleeve 343 from the discharge passage 266A, passes through the refrigerant discharge tube 296, and is discharged to the outside of the airtight container 212.

Figure 4:
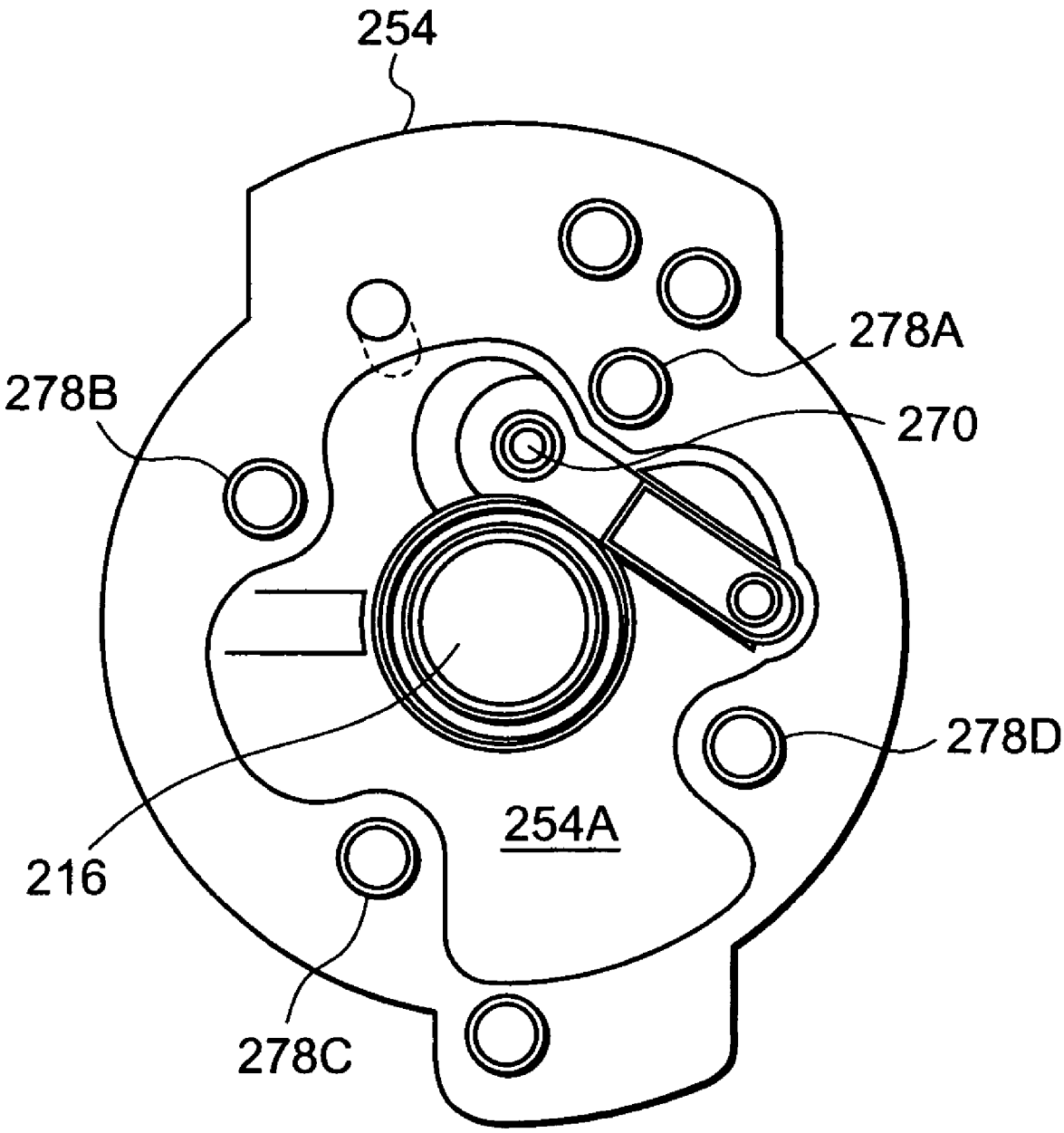
FIG. 4 is a plan view of an upper support member constituting the rotary compressor of FIG. 3.

On the other hand, a plurality of bolt holes 278A, 278B, 278C, 278D for inserting the fastening bolts 278 are disposed at a predetermined interval centering on the rotation shaft 216 in the vicinity of the outer periphery of the upper support member 254, and these bolt holes 278A, 278B, 278C, 278D are arranged in order in a counterclockwise direction (FIG. 4). The concave portion 254A formed in the upper support member 254 is dented/formed into a four-leaf clover shape dented in the vicinity of the outer diameter of the upper support member 254 avoiding the respective bolt holes 278A, 278B, 278C, 278D. The concave portion 254A is also dented/formed between the bolt holes 278C, 278D between which a conventional collar of the refrigerant discharge tube 296 is fitted. Accordingly, a volume in the discharge noise silencing chamber 262 is enlarged. It is to be noted that reference numeral 270 denotes a discharge port of the cylinder 238, and the port is openably closed by a discharge valve constituted of a leaf spring (not shown).

Next, an operation of the above-described constitution will be described. When the stator coil 228 of the driving element 214 is excited via the terminal 220 and a wiring (not shown), the driving element 214 starts, and the rotor 224 rotates. By the rotation, the upper and lower rollers 246, 248 fitted into the upper and lower eccentric portions 242, 244 disposed integrally with the rotation shaft 216 eccentrically rotate in the upper and lower cylinders 238, 240.

Accordingly, a low-pressure refrigerant drawn in the lower cylinder 240 on the side of a low pressure chamber from a suction port (not shown) via the refrigerant introducing tube 294 and the suction passage 258 formed in the lower support member 256 is compressed by the operation of the roller 248 and vane to obtain an intermediate pressure. The gas is discharged into the airtight container 212 from the intermediate discharge tube via a communication path (not shown) from the lower cylinder 240 on the side of a high pressure chamber. Accordingly, the inside of the airtight container 12 attains the intermediate pressure.

Moreover, the refrigerant gas having the intermediate pressure in the airtight container 212 flows out of the sleeve, and is drawn in the cylinder 238 on the side of the low pressure chamber from the suction port via the refrigerant introducing tube 292 and a suction passage (not shown) formed in the upper support member 254. The intermediate-pressure refrigerant gas drawn in the cylinder 238 on the side of the low pressure chamber is compressed in a second stage by the operation of the roller 246 and vane to constitute a high-temperature/pressure refrigerant gas. The gas passes through a discharge port from the side of the high pressure chamber, and flows into the discharge noise silencing chamber 262 formed in the upper support member 254.

Furthermore, pulsation of the high-temperature/pressure discharged gas which has flown into the discharge noise silencing chamber 62 is alleviated. Thereafter, the gas passes through the discharge passage 266A formed in the upper cover 266, then passes through the refrigerant discharge tube 296 from the collar C, and flows into an external gas cooler (not shown) or the like. After the refrigerant radiates heat in the gas cooler, the refrigerant is decompressed by a decompressor (not shown), and flows into an evaporator (not shown).

Then, the refrigerant evaporates, and is thereafter drawn in the first rotary compression element 232 from the refrigerant introducing tube 294. This cycle is repeated.

As described above, the discharge passage 266A for discharging the refrigerant discharged into the discharge noise silencing chamber 262 from the cylinder 238 to the outside of the airtight container 212 is formed in the upper cover 266 which closes the opening of the concave portion 254A formed in the upper support member 254 on a side opposite to the cylinder 238 of the discharge noise silencing chamber 262. Therefore, even when the concave portion 254A is formed between the bolt holes 278C, 278D of the upper support member 254 to enlarge the volume of the discharge noise silencing chamber 262, the collar C of the refrigerant discharge tube 296 for discharging the refrigerant can be inserted/connected into the upper cover 266. Accordingly, even when the airtight container 212 is not enlarged, noises generated by the pulsation of the discharged gas can be reduced.

Figure 5:
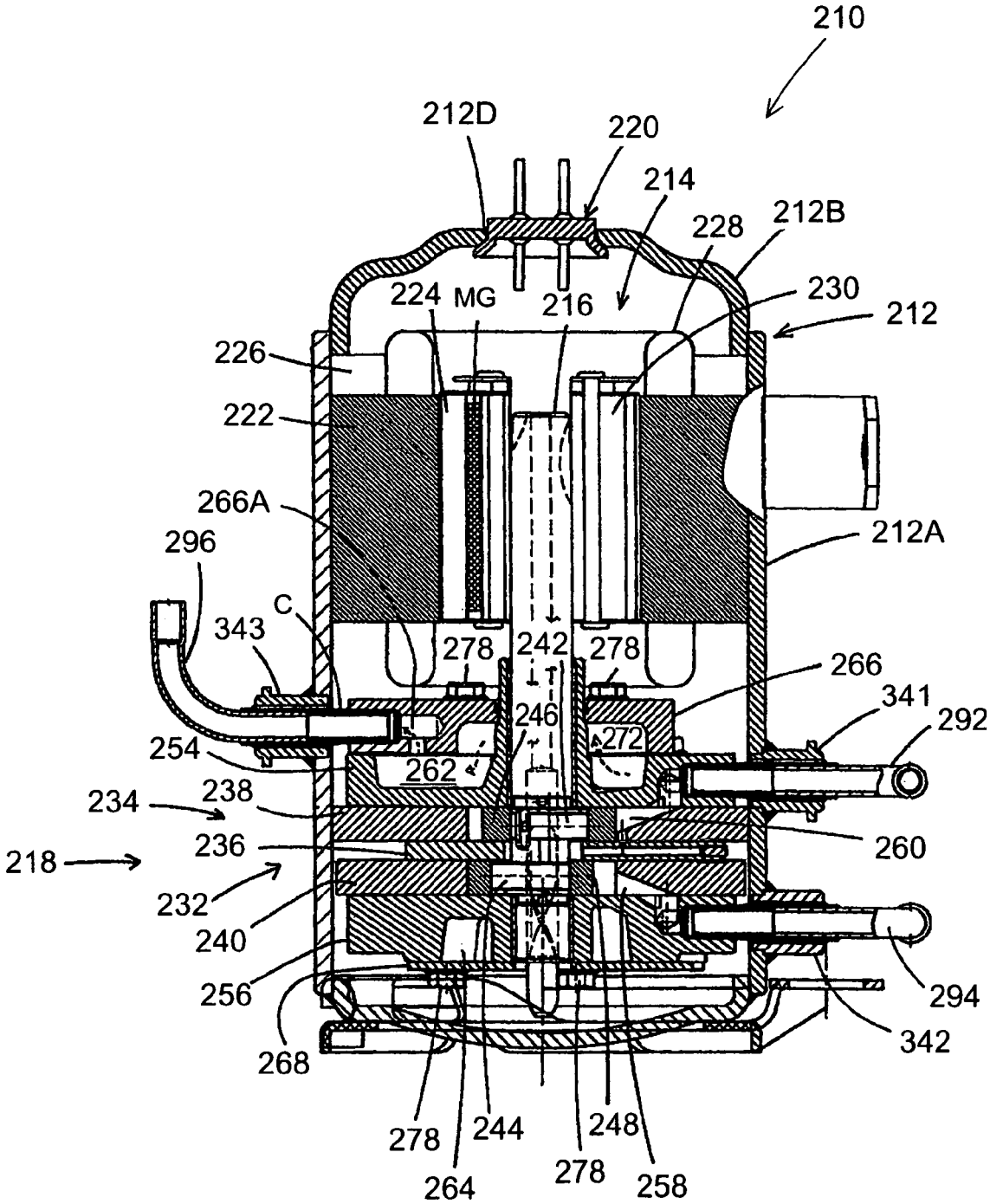
FIG. 5 is a vertical side view of the rotary compressor according to another embodiment of the present invention.

Next, FIG. 5 shows a vertically sectional side view of the rotary compressor 210 according to another embodiment of the present invention. It is to be noted that the same parts as those of FIGS. 3 and 4 are denoted with the same reference numerals, and description thereof is omitted. In the rotary compressor 210 described in the above embodiment, an upper cover side discharge noise silencing chamber 272 which communicates with the discharge noise silencing chamber 262 is formed in the upper cover 266.

In the thick upper cover 266, portions other than connecting portions of the sleeve 343 are carved on the side of the driving element 214, and dented to form the discharge noise silencing chamber 272. Moreover, the discharge noise silencing chamber 272 is connected to the discharge noise silencing chamber 262. Accordingly, the discharge noise silencing chamber 262 is further enlarged, and the refrigerant gas flows as shown by a broken-line arrow in the figure. That is, since the upper cover side discharge noise silencing chamber 272 communicating with the discharge noise silencing chamber 262 is formed in the upper cover 266, the volume of the discharge noise silencing chamber 262 can further be enlarged. Accordingly, even when the airtight container 212 is not enlarged, the noises generated by the pulsation of the discharged gas can be reduced, and the noises generated by the pulsation can further be reduced.

Figure 6:
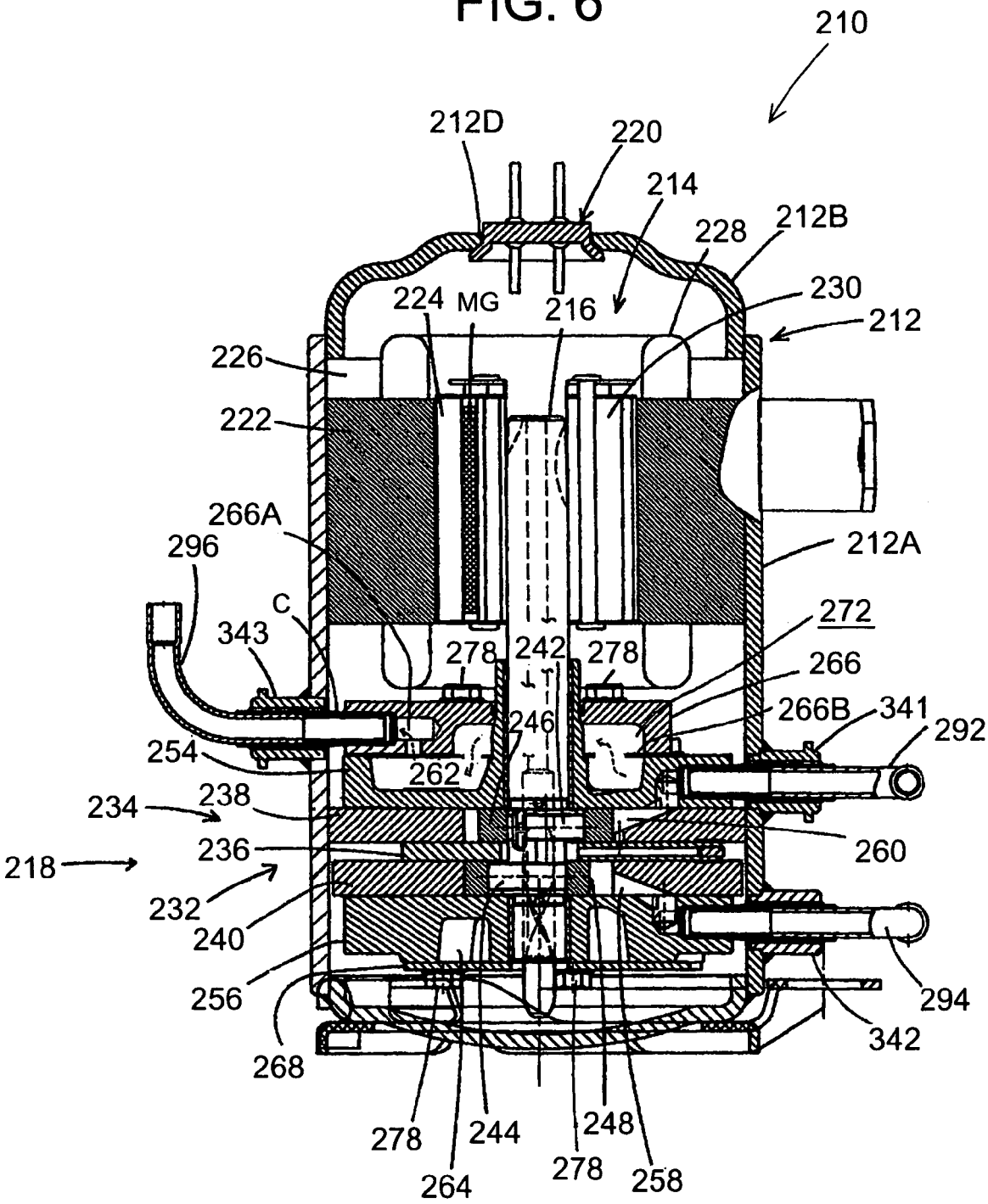
FIG. 6 is a vertical side view of the rotary compressor according to still another embodiment of the present invention.

Next, FIG. 6 shows a vertically sectional side view of the rotary compressor 210 according to still another embodiment of the present invention. It is to be noted that the same parts as those of FIGS. 3 to 5 are denoted with the same reference numerals, and the description is omitted. In the rotary compressor 210 described in the embodiment of FIG. 5, the discharge passage 266A is partitioned from an upper cover side discharge noise silencing chamber 272 by a partition plate 266B, and communicates with the discharge noise silencing chamber 262 in this state.

Thus, the discharge passage 266A partitioned from the upper cover side discharge noise silencing chamber 272 communicates with the discharge noise silencing chamber 262. Accordingly, the refrigerant gas flows as shown by a broken-line arrow in the figure. In addition to the function of FIG. 5, a distance from the discharge port of the cylinder 238 to the discharge passage 266A can be lengthened. Accordingly, the pulsation of the discharged gas is further reduced, and an effect of silencing the noise of the discharged gas can be remarkably increased.

Figure 7:
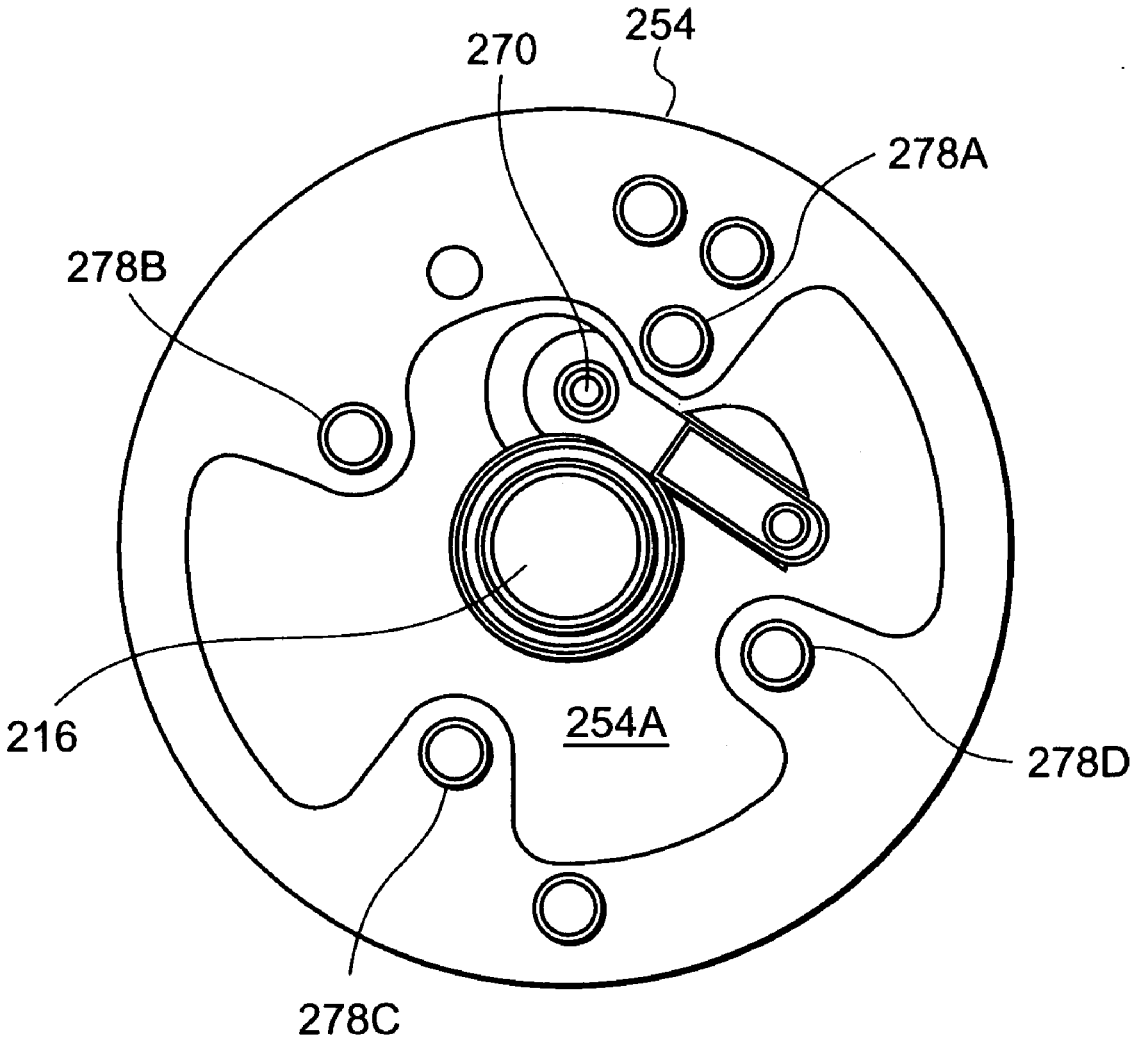
FIG. 7 is a plan view of the upper support member constituting the rotary compressor according to still another embodiment of the present invention.

Next, FIG. 7 shows a plan view of the upper support member 254 constituting the rotary compressor 210 according to another embodiment of the present invention. It is to be noted that the same parts as those of FIGS. 3 to 6 are denoted with the same reference numerals, and description thereof is omitted. In the rotary compressor 210 described in the above embodiment, an outer diameter of the upper support member 254 is formed substantially into a circular shape, and a periphery of the upper support member 254 is formed into a circular shape which substantially contacts an inner periphery of the cylindrical airtight container 212.

The concave portion 254A is formed in the upper support member 254, and the concave portion 254A is dented/formed into a four-leaf clover shape avoiding the respective bolt holes 278A, 278B, 278C, 278D as described above. The concave portion 254A is dented/formed even between the bolt holes 278C, 278D between which the collar of the refrigerant discharge tube 296 has been heretofore fitted. That is, the outer diameter of the upper support member 254 is formed into the circular shape which substantially contacts the inner periphery of the cylindrical airtight container 212. Moreover, the concave portion 254A is formed into the four-leaf clover shape dented in the vicinity of the outer diameter of the upper support member 254 avoiding the respective bolt holes 278A, 278B, 278C, 278D. Accordingly, since the volume in the discharge noise silencing chamber 262 can further be enlarged, an effect similar to the above-described effect can be obtained. It is to be noted that reference numeral 270 denotes a discharge port of the cylinder 238, and the port is openably closed by a discharge valve constituted of a leaf spring (not shown). A communication path (not shown) for allowing the oil which is the lubricant supplied on the side of the driving element 214 to flow downstream is formed in the upper support member 254 within the scope of a strength of the upper support member 254 or a function of the discharge noise silencing chamber 262.

It is to be noted that in the respective embodiments of FIGS. 3 to 7, the present invention is applied to the rotary compressor 210 of the internal intermediate pressure type multistage compression system, but is not limited to the compressor, and the present invention is also effective in a rotary compressor including a single cylinder.

As described above in detail, according to the present invention, even when the volume of the discharge noise silencing chamber formed in the support member is enlarged, an attaching dimension for attaching a piping for discharging the refrigerant can be secured. Accordingly, the noises generated by the pulsation of the discharged gas can be effectively reduced.

Moreover, since the cover side discharge noise silencing space communicating with the discharge noise silencing chamber is formed in the cover, the volume of the discharge noise silencing chamber can further be enlarged. Accordingly, the noises generated by the pulsation of the discharged gas can further be reduced.

Furthermore, since the discharge passage partitioned from the cover side discharge noise silencing space is connected to the discharge noise silencing chamber, the distance from the cylinder to the discharge passage can be lengthened. Accordingly, the pulsation of the discharged gas can further be reduced, and the effect of silencing the noise of the discharged gas can be remarkably increased.

Figure 8:
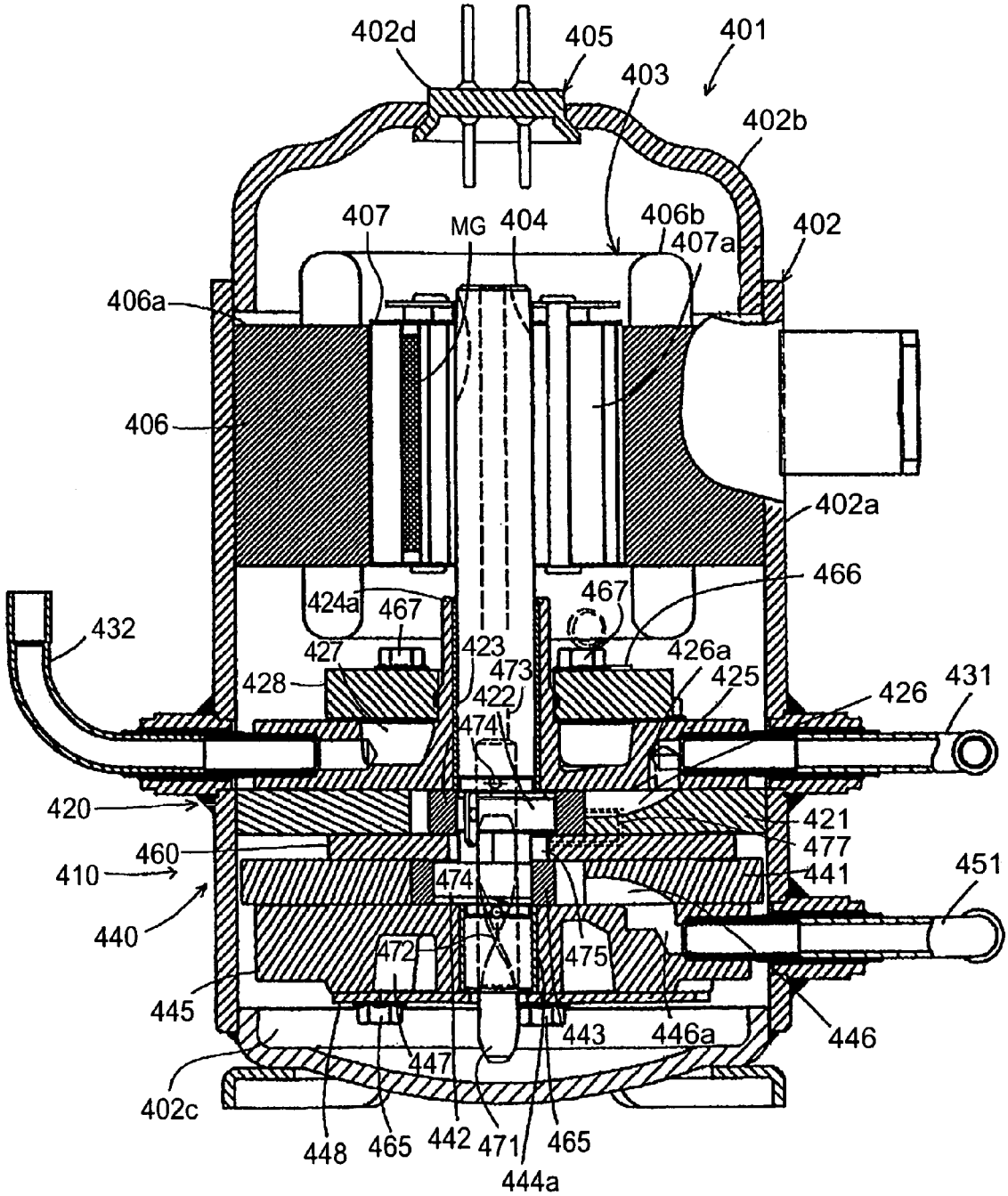
FIG. 8 is a vertical sectional view of a two-stage compression system rotary compressor according to still another embodiment of the present invention.

Next, another embodiment of the present invention will be described in detail with reference to FIGS. 8 to 13. FIG. 8 shows a two-stage compression system rotary compressor 401 according to the embodiment of the rotary compressor of the present invention. That is, a vertically sectional view of the two-stage compression system rotary compressor 401 of an intermediate pressure dome type including a second stage compression element 420 and a first stage compression element 440 is shown.

As shown in FIG. 8, the two-stage compression system rotary compressor 401 according to the present embodiment is constituted of: a cylindrical airtight container 402 formed of a steel plate; an electric motor 403 disposed on an upper side of an inner space of the airtight container 402; a rotary compression mechanism section 410 disposed under the electric motor 403; an oil supply mechanism 470 for supplying oil to a sliding portion of the rotary compression mechanism section 410 and the like.

It is to be noted that in the two-stage compression system rotary compressor 401, carbon dioxide ($CO_2$) described above, which is an ecologically friendly natural refrigerant, is used as the refrigerant in consideration of flammability, toxicity and the like. Existing oils such as mineral oil, alkyl benzene oil, ether oil, and ester oil are used as lubricating oils.

The above-described constitution will be described in more detail. The airtight container 402 is constituted of a container main body 402*a* in which the rotary compression mechanism section 410 of the electric motor 403 is housed, and a substantially bowl-shaped end cap 402*b* which closes an upper opening of the container main body 402*a*. A bottom part of the container is constituted as an oil reservoir 402*c*. A circular attaching hole 402*d* is formed in an upper surface center of the end cap 402*b*, and a terminal (wiring is omitted) 405 for supplying a power to the electric motor 403 is attached to the attaching hole 402*d*.

The electric motor 403 is constituted of a stator 406 attached in an annular shape along an inner peripheral surface of an upper space of the airtight container 402, and a rotor 407 inserted/disposed inside the stator 406 with a slight interval.

The stator 406 includes a stacked member 406*a* in which donut-shaped electromagnetic steel plates are stacked upon one another, and a stator coil 406*b* wound around a teeth portion of the stacked member 406*a* by a direct winding (concentrated winding) system. The rotor 407 is also formed of a stacked member 407*a* of electromagnetic steel plates in the same manner as in the stator 406, and a permanent magnet MG is inserted/constituted in the stacked member 407*a*. Moreover the rotor 407 is fixed to a rotation shaft 404 extending through the center of the electric motor 403 in a perpendicular direction.

The rotary compression mechanism section 410 is constituted of the second stage compression element 420 and the first stage compression element 440 which are driven by the rotation shaft 404 of the electric motor 403. The second stage compression element 420 and the first stage compression element 440 are constituted of: an intermediate partition plate 460; upper and lower cylinders 421, 441 disposed on/under the intermediate partition plate 460; upper and lower eccentric portions 422, 442 disposed on the rotation shaft 404 with a phase difference of 180 degrees in the upper and lower cylinders 421, 441; upper and lower rollers 423, 443 (see FIGS. 11, 12) fitted into the upper and lower eccentric portions 422, 442 to eccentrically rotate; upper and lower vanes 424, 444 (see FIGS. 11, 12) which abut on the upper and lower rollers 423, 443 to divide the insides of the upper and lower cylinders 421, 441 into low and high pressure chamber sides; and upper and lower support members 425, 445 which are support members for blocking an upper opening surface of the upper cylinder 421 and a lower opening surface of the lower cylinder 441 and for serving also as bearings of the rotation shaft 404.

In the upper and lower support members 425, 445, suction passages 426*a*, 446*a* which connect suction ports 426, 446 (see FIGS. 11, 12) to the insides of the upper and lower cylinders 421, 441, respectively, and dented discharge noise silencing chambers 427, 447. It is to be noted that the discharge noise silencing chambers 427, 447 communicate with discharge ports 429, 449. Openings of these discharge noise silencing chambers 427, 447 are closed by covers, respectively. That is, the discharge noise silencing chamber 427 is closed by an upper cover 428, and the discharge noise silencing chamber 447 is closed by a lower cover 448.

Moreover, an upper bearing 424*a* is vertically formed in a middle of the upper support member 425, and a lower bearing 444*a* is formed in such a manner as to extend through the middle of the lower support member 445. Moreover, the rotation shaft 404 is supported by the upper bearing 424*a* of the upper support member 425 and the lower bearing 444*a* of the lower support member 445.

Figure 10:
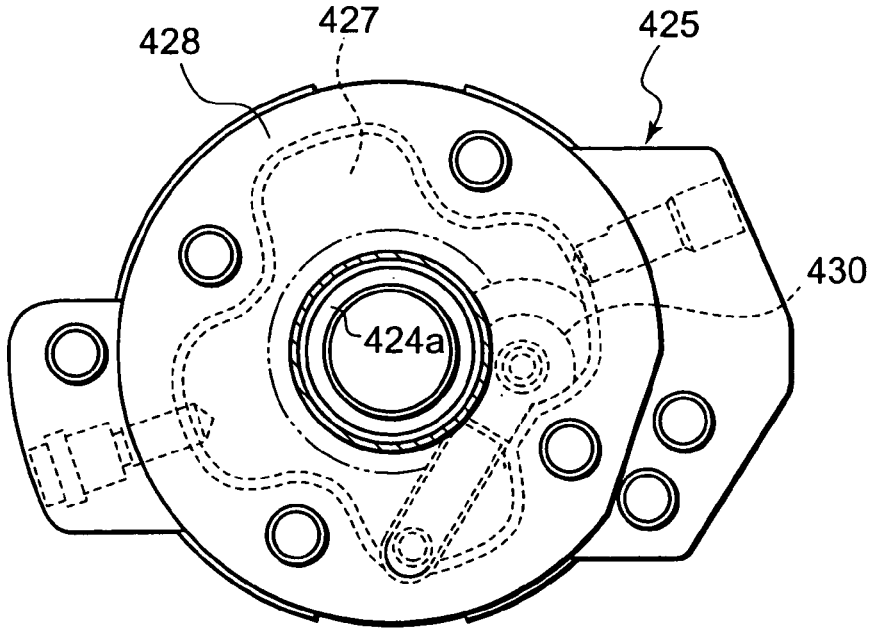
FIG. 10 is an upper surface view of the upper support member and an upper cover of the two-stage compression system rotary compressor of FIG. 8.

The upper cover 428 closes the upper surface opening of the discharge noise silencing chamber 427 to partition the airtight container 402 into a discharge noise silencing chamber 427 side and an electric motor 403 side. As shown in FIG. 10, the upper cover 428 is constituted of a substantially donut-shaped circular steel plate in which a hole for passing the upper bearing 424*a* of the upper support member 425 is formed, and a peripheral portion of the upper cover is fixed to the upper support member 425 from above by main bolts 467. Tips of the main bolts 467 engage with the lower support member 445. It is to be noted that, as shown in FIG. 10, a discharge valve 430 of the second stage compression element 420 for opening/closing the discharge port 429 is disposed in an upper part of the upper support member 425 in a state in which the valve is positioned in the discharge noise silencing chamber 427.

The lower cover 448 is constituted of a donut-shaped circular steel plate, and fixed to the lower support member 445 from below by main bolts 465 in a peripheral portion thereof. It is to be noted that tips of the main bolts 465 engage with the upper support member 425.

Figure 9:
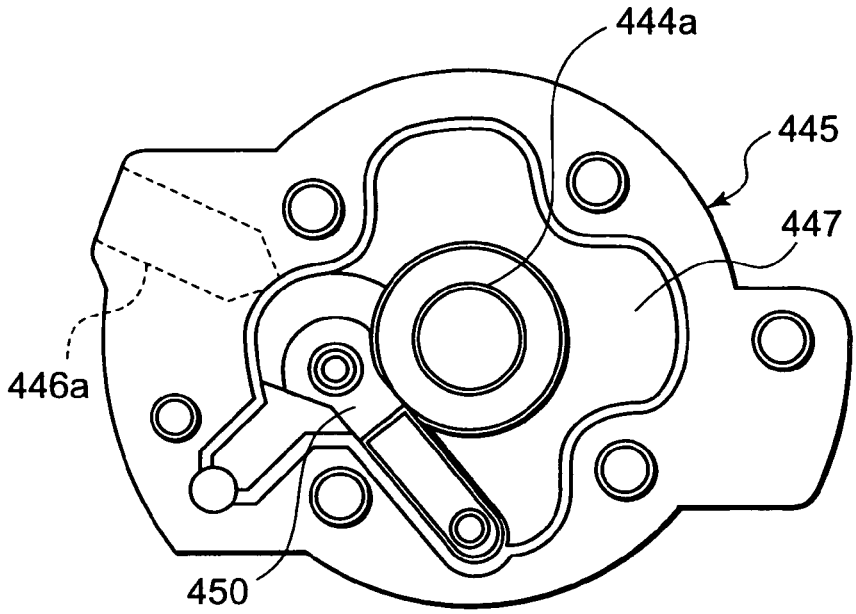
FIG. 9 is a lower surface view of a lower support member of the two-stage compression system rotary compressor of FIG. 8.

As shown in FIG. 9, a discharge valve 450 of the first stage compression element 440 for opening/closing the discharge port 449 is disposed in a lower surface of the lower support member 445 in a state in which the valve is positioned in the discharge noise silencing chamber 447.

As shown in FIGS. 9 and 10, the discharge valves 430, 450 are constituted of elastic members such as vertically long metal plates. The discharge valves 430, 450 are fixed by screws (not shown) on their one-end sides, and are screwed/attached to the upper support member 425 or the lower support member 445 in such a manner as to elastically abut on and close the discharge ports 429, 449 on their other-end sides.

Moreover, the discharge noise silencing chamber 447 is connected to the electric motor 403 side of the upper cover 428 in the airtight container 402 via a communication path (not shown) which is a hole extending through the upper and lower cylinders 421, 441 and the intermediate partition plate 460. Moreover, an intermediate discharge tube 466 is vertically disposed on an upper end of the communication path (not shown), and the intermediate discharge tube 466 is constituted in such a manner as to discharge an intermediate-pressure refrigerant into the airtight container 402 therefrom.

As shown in FIG. 8, a suction piping 451 of the first stage compression element 440 is connected/attached to the suction passage 446*a* of the lower support member 445. One end of a suction piping 431 of the second stage compression element 420 is connected into the airtight container 402 on the upper side of the upper cover 428, although not shown. The other end of the suction piping communicates with the suction passage 426*a* of the second stage compression element 420. A discharge piping 432 of the second stage compression element 420 is attached in such a manner as to be taken out of the discharge noise silencing chamber 427 of the second stage compression element 420.

Next, the oil supply mechanism 470 will be described. A paddle 471 formed by twisting a pipe in a spiral shape is attached to a lower part of the rotation shaft 404. A lower end of the paddle 471 is immersed into the oil stored in the oil reservoir 402*c*, rotates simultaneously with the rotation of the rotation shaft 404, and constitutes a pump mechanism for pumping up the oil of the oil reservoir 402*c* by a centrifugal force. The oil pumped up by the paddle 471 is supplied to the lower bearing 444*a*, the upper bearing 424*a*, and a space portion 475 which is an oil supply passage formed in a central portion of the intermediate partition plate 460 via an oil groove 472 formed in the paddle 471, an oil communication path 473 disposed in a vertical direction in an axial center of the rotation shaft, and an oil communication path 474 disposed in a transverse direction to communicate with the oil communication path 473 in the vertical direction. The space portion 475 is a space inside the roller, which is divided by the upper and lower eccentric portions 422, 442 of the rotation shaft 404 and the upper and lower support members. The above-described constitution is the same as that of a conventional known oil supply mechanism. Additionally, the oil supply mechanism 470 of the present embodiment is different from a conventional constitution in that one end of the mechanism opens in the space portion 475 which is an oil passage and the other end thereof includes an oil supply passage 477 opened in the upper cylinder 421.

Figure 13:
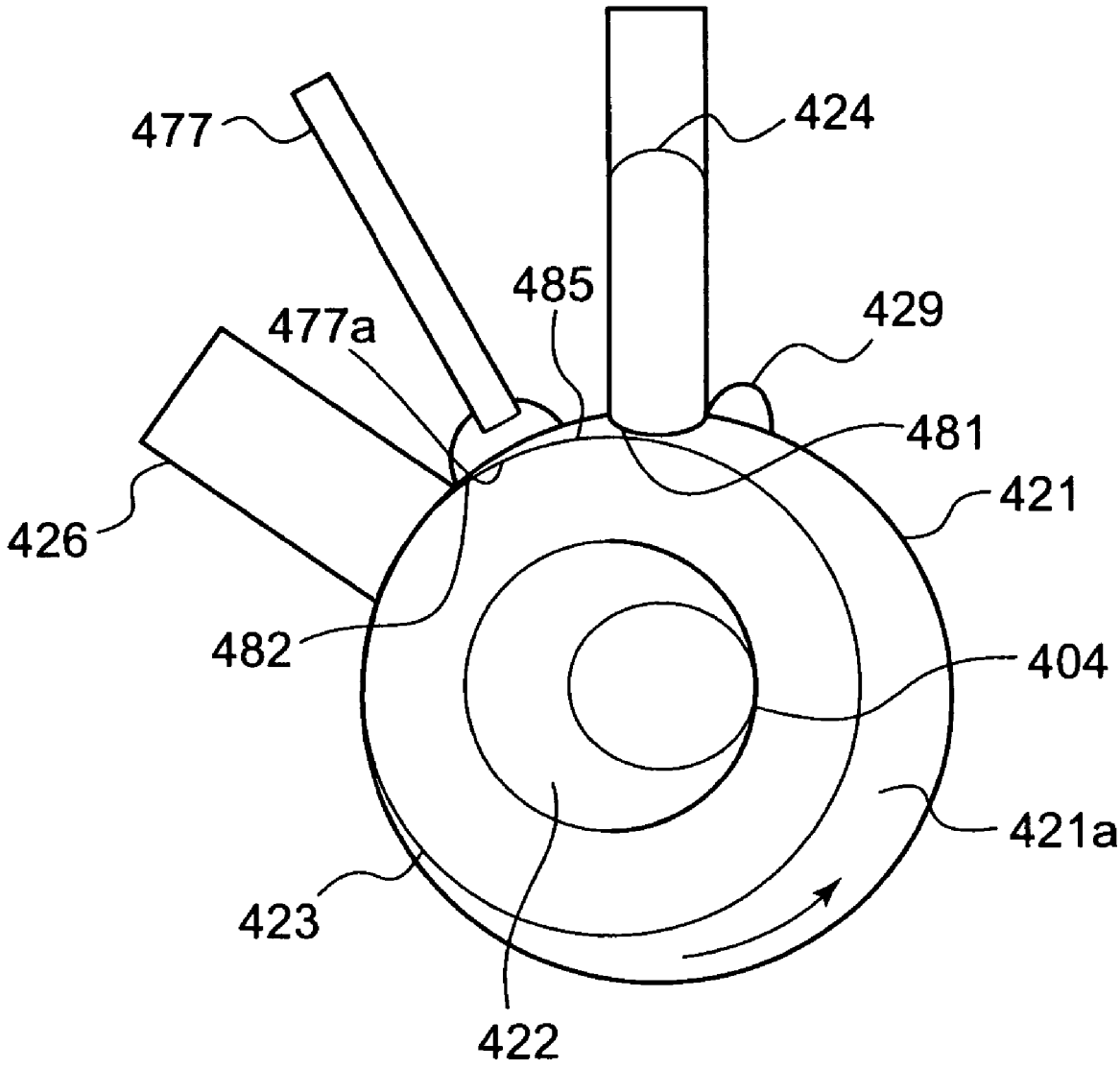
FIG. 13 is a schematically enlarged view around an opening of an oil supply passage in the upper cylinder of the two-stage compression system rotary compressor of FIG. 8.

As shown in FIG. 13, an opening 477*a* of the oil supply passage 477 in the upper cylinder 421 is opened in a space portion 485 formed between a compression step end point 481 and a suction step start point 482 in the upper cylinder 421.

An operation of the two-stage compression system rotary compressor 401 according to the present embodiment constituted as described above will be described.

The stator coil 406*b* of the electric motor 403 is energized via the terminal 405 and a wiring (not shown). When the stator coil 406*b* is energized, the electric motor 403 starts, and the rotor 407 rotates. By the rotation of the rotor 407, the upper and lower eccentric portions 422, 442 in the second stage compression element 420 and the first stage compression element 440 disposed integrally with the rotation shaft 404 rotate, and the upper and lower rollers 423, 443 fitted into the upper and lower eccentric portions 422, 442 eccentrically rotate in the upper and lower cylinders 421, 441.

Figure 11:
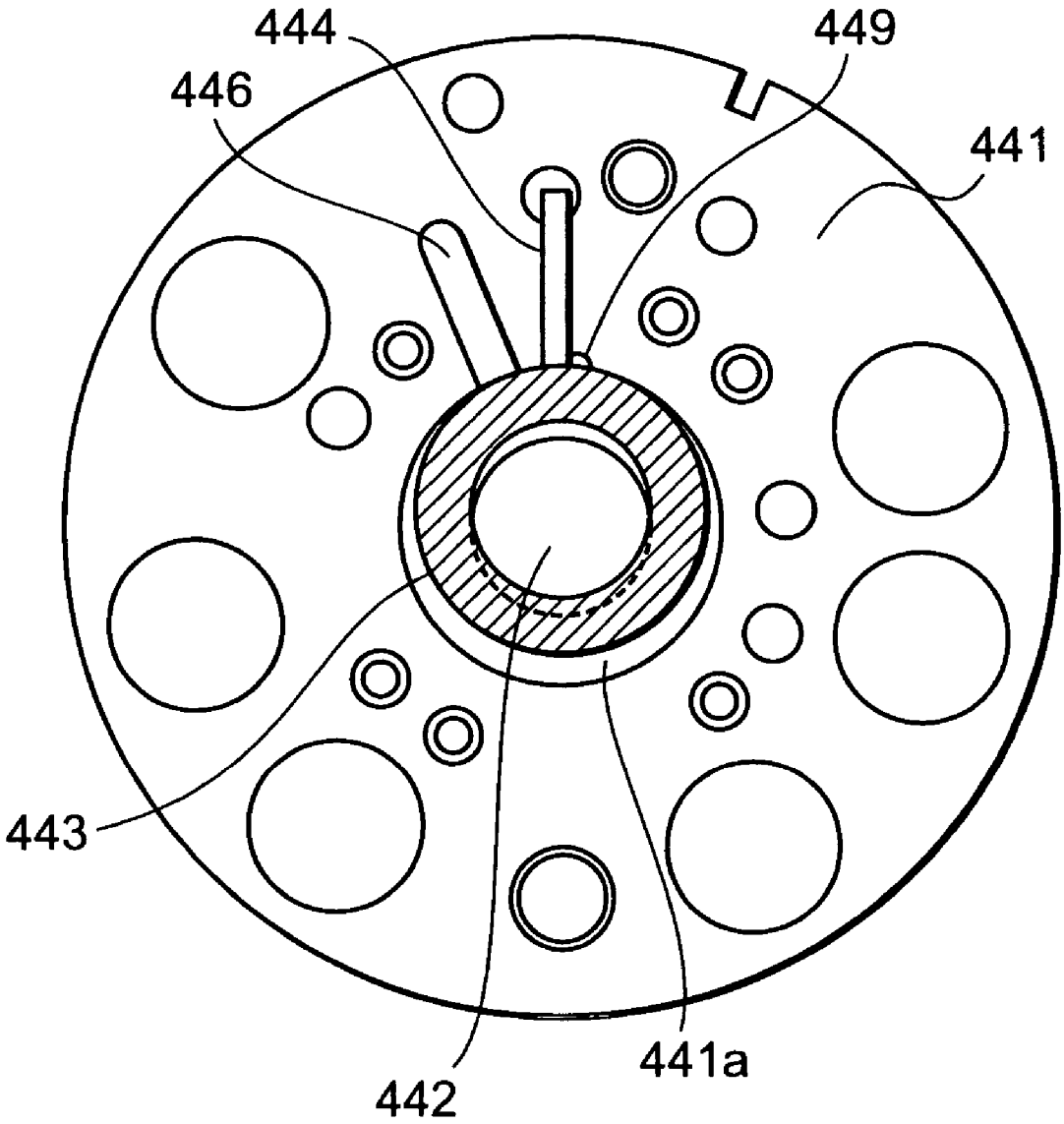
FIG. 11 is a lower surface view of a lower cylinder of the two-stage compression system rotary compressor of FIG. 8.
Figure 12:
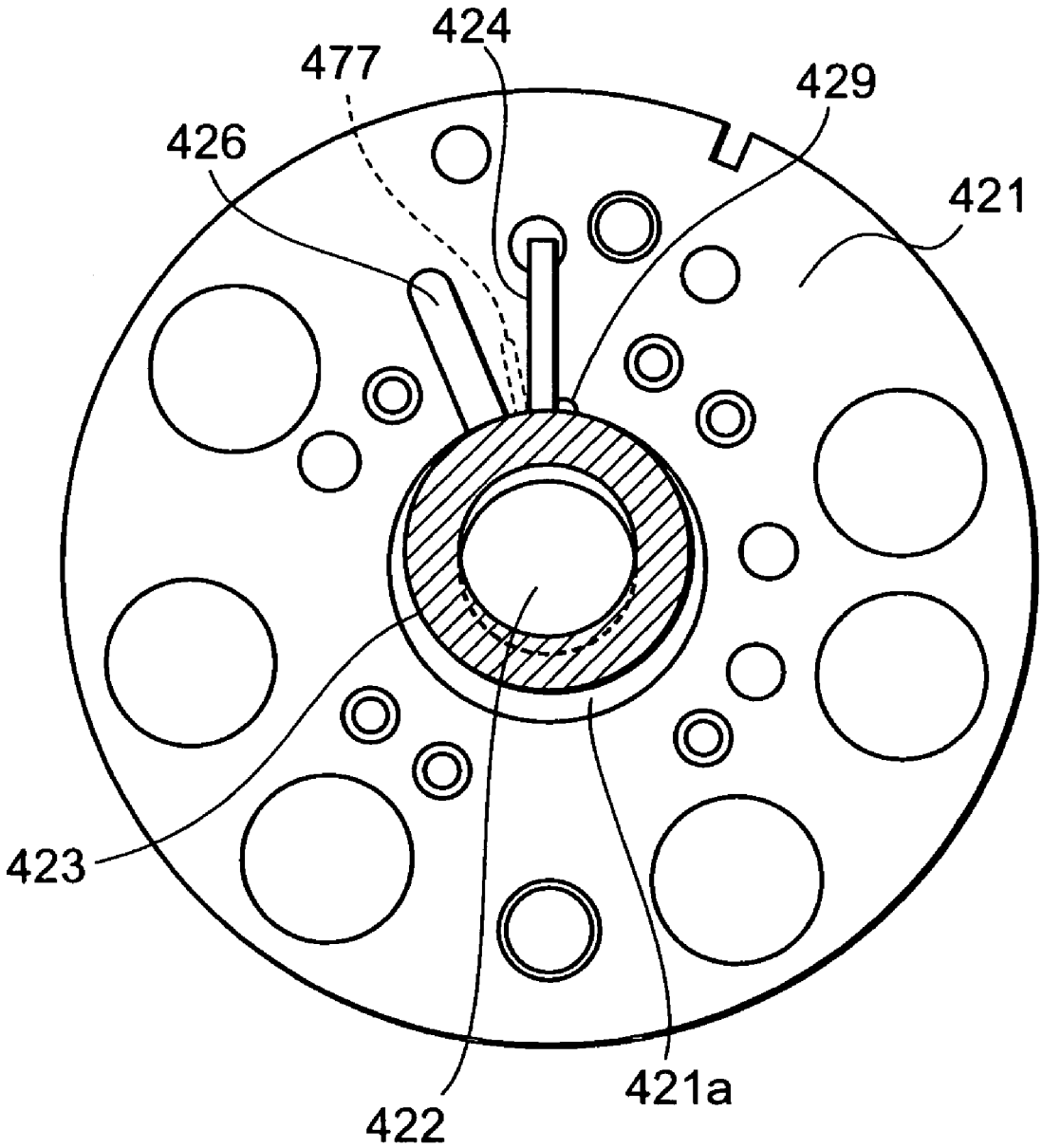
FIG. 12 is an upper surface view of an upper cylinder of the two-stage compression system rotary compressor of FIG. 8.

Accordingly, in the first stage compression element 440, the refrigerant in a refrigerant circuit connected to the outside is drawn in a compression chamber 441*a* of the lower cylinder 441 on the low pressure chamber side via the suction piping 451, and the suction passage 446*a* formed in the lower support member 445 and further via a suction port 446 shown in a lower surface view of the lower cylinder 441 in FIG. 11. A low-pressure (LP) refrigerant drawn in the compression chamber 441*a* of the lower cylinder 441 on the low pressure chamber side is compressed by the operation of the lower roller 443 and the lower vane 444 to obtain an intermediate pressure (MP), and discharged into the discharge noise silencing chamber 447 formed in the lower support member 445 from the lower cylinder 441 on the high pressure chamber side via the discharge port 449.

The gas refrigerant having the intermediate pressure discharged into the discharge noise silencing chamber 447 is discharged into the airtight container 402 from the intermediate discharge tube 466 via a communication path (not shown), and accordingly the inside of the airtight container 402 obtains the intermediate pressure.

The gas refrigerant having the intermediate pressure in the airtight container 402 is passed through the suction piping 431, drawn in the second stage compression element 420, and compressed in the second stage. That is, the intermediate-pressure gas refrigerant is drawn in the compression chamber 421*a* of the upper cylinder 421 on the low pressure chamber side from the suction port 426 shown in an upper surface view of the upper cylinder 421 in FIG. 12 via the suction passage 426*a* formed in the upper support member 425. The drawn-in intermediate-pressure gas refrigerant is compressed in the second stage by the operation of the upper roller 423 and the upper vane 424 to constitute a gas refrigerant having a high temperature and pressure (HP), and is discharged from the high pressure chamber side via the discharge port 429. The discharged refrigerant in the second stage compression element 420 is circulated in a refrigerant circuit (not shown) disposed outside the two-stage compression system rotary compressor 401 from the discharge noise silencing chamber 427 formed in the upper support member 425 via the discharge piping 432, and drawn in a first stage compression element 440 side again.

At the time of the compression operation, the oil stored in the oil reservoir 402*c* is pumped up by a pumping function of the paddle 471. The pumped-up oil is supplied to the upper and lower bearings 424*a*, 444*a* and a sliding portion of the space portion 475 or the like via the oil communication path 473 in the vertical direction and the oil communication path 474 in the transverse direction.

Moreover, at the time of the compression operation, after the contact point 485 between the upper roller 423 and the upper cylinder 421 passes through the opening 477*a*, the opening 477*a* of the oil supply passage 477 communicates with the space portion 485 formed between the contact point 485 and the compression step end point 481. The space portion 485 is formed between the compression step end point 481 and the suction step start point 482 and is therefore a negative pressure portion. Therefore, by use of a negative pressure in the space portion 485, the oil supply passage 477 is capable of sufficiently supplying the oil stored in the space portion 475 which is the oil passage into the upper cylinder 421.

It is to be noted that a supply amount of the oil into the upper cylinder 421 by the oil supply passage 477 can be adjusted, when a time for communication of an element influencing an oil passage resistance or the opening 477*a* of the oil supply passage 477 with the space portion is changed.

For example, when a sectional area of the oil supply passage 477 is reduced, or a bent portion of the oil supply passage 477 is formed at an acute angle, the oil passage resistance of the oil supply passage 477 increases, and the oil supply amount into the space portion 485 can be decreased. Moreover, when the opening 477*a* is expanded as shown in FIG. 13 or the opening 477*a* of the oil supply passage 477 is brought close to the compression step end point 481, an opening time of the oil supply passage 477 into the space portion 485 lengthens, and the oil supply amount into the space portion 485 can be increased.

As described above, in the rotary compression mechanism section, the rotor contacts the cylinder wall while rotating to perform a compression function. In this case, while the contact point between the rotor and the cylinder wall moves to the compression step end point or the suction step start point, the negative pressure space is formed.

Therefore, in the present invention, noting that such a negative pressure region is formed in the cylinder of the second stage compression element, the oil supply passage is disposed whose one end opens in the space portion as the oil passage formed in the outer periphery of the rotation shaft of the electric motor and whose other end opens in the space portion formed between the compression step end point and the suction step start point in the cylinder wall of the second stage compression element. Therefore, the oil can be sufficiently supplied into the cylinder of the second stage compression element from the oil passage of the oil supply mechanism. The oil supply amount into the cylinder of the second stage compression element can be adjusted, when the oil passage resistance of the oil supply passage, a time for opening the oil supply passage into the in-cylinder space portion between the compression step end point and the suction step start point and the like are changed.

It is to be noted that the above-described embodiment has been described in accordance with the two-stage compression system rotary compressor, but the present invention is not limited to the embodiment, and the present invention is also applicable to a multistage compression system rotary compressor in which the rotary compression mechanism section 410 is constituted of three, four or more stages.

The multistage compression system rotary compressor described above in detail is used in air conditioners for household use, air conditioners for business use (package air conditioner), air conditioners for automobiles, heat pump type water heaters, refrigerators for household use, refrigerators for business use, freezers for business use, freezers/coolers for business use, automatic dispensers and the like.

Figure 14:
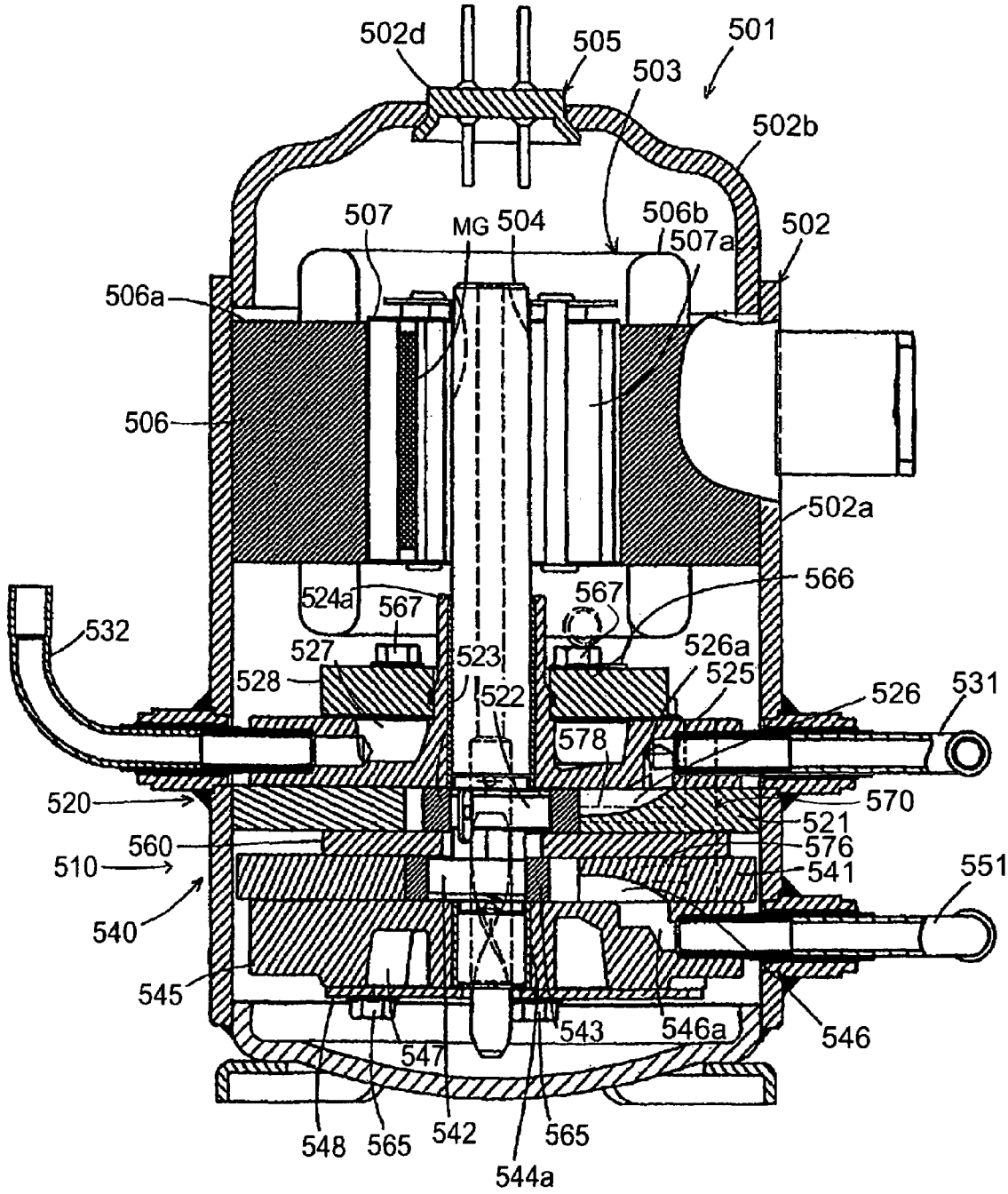
FIG. 14 is a vertical sectional view of the two-stage compression system rotary compressor according to still another embodiment of the present invention.

Next, still another embodiment of the present invention will be described in detail with reference to FIGS. 14 to 21. FIG. 14 shows a vertically sectional view of a two-stage compression system rotary compressor embodying the rotary compressor of the present invention in this case, that is, an intermediate pressure dome type two-stage compression system rotary compressor including high and low stage side compression elements.

As shown in FIG. 14, a two-stage compression system rotary compressor 501 according to the embodiment is constituted of: a cylindrical airtight container 502 formed of a steel plate; an electric motor 503 disposed on an upper side of an inner space of the airtight container 502; a rotary compression mechanism section 510 disposed under the electric motor 503; a pressure control valve 570 housed in a housing constituting the rotary compression mechanism section 510 and the like.

The airtight container 502 is constituted of a container main body 502*a* in which the rotary compression mechanism section 510 of the electric motor 503 is housed, and a substantially bowl-shaped end cap 502*b* which closes an upper opening of the container main body 502*a*. A bottom part of the container is constituted as an oil reservoir. A circular attaching hole 502*d* is formed in an upper surface center of the end cap 502*b*, and a terminal (wiring is omitted) 505 for supplying a power to the electric motor 503 is attached to the attaching hole 502*d*.

The electric motor 503 is constituted of a stator 506 attached in an annular shape along an inner peripheral surface of an upper space of the airtight container 502, and a rotor 507 inserted/disposed inside the stator 506 with a slight interval. The electric motor is constituted in such a manner that a rotation number can be controlled.

The stator 506 includes a stacked member 506*a* in which donut-shaped electromagnetic steel plates are stacked upon one another, and a stator coil 506*b* wound around a teeth portion of the stacked member 506*a* by a direct winding (concentrated winding) system. The rotor 507 is also formed of a stacked member 507*a* of electromagnetic steel plates in the same manner as in the stator 506, and a permanent magnet MG is inserted/constituted in the stacked member 507*a*. Moreover, the rotor 507 is fixed to a rotation shaft 504 extending through the center of the electric motor 503 in a perpendicular direction.

The rotary compression mechanism section 510 is constituted of a high stage side compression element 520 and a low stage side compression element 540 which are driven by the rotation shaft 504 of the electric motor 503. The high stage side compression element 520 and the low stage side compression element 540 are constituted of: an intermediate partition plate 560; upper and lower cylinders 521, 541 disposed on/under the intermediate partition plate 560; upper and lower eccentric portions 522, 542 disposed on the rotation shaft 504 with a phase difference of 180 degrees in the upper and lower cylinders 521, 541; upper and lower rollers 523, 543 (see FIGS. 17, 18) fitted into the upper and lower eccentric portions 522, 542 to eccentrically rotate; upper and lower vanes 524, 544 (see FIGS. 17, 18) which abut on the upper and lower rollers 523, 543 to divide the insides of the upper and lower cylinders 521, 541 into low and high pressure chamber sides; and upper and lower support members 525, 545 which are support members for blocking an upper opening surface of the upper cylinder 521 and a lower opening surface of the lower cylinder 541 to also serve as bearings of the rotation shaft 504.

It is to be noted that the intermediate partition plate 560, the cylinders 521, 541, the upper support member 525, and the lower support member 545 constitute a housing of the rotary compression mechanism section 510 mentioned in the present invention.

In the upper and lower support members 525, 545, suction passages 526*a*, 546*a* which connect suction ports 526, 546 (see FIGS. 17, 18) to the insides of the upper and lower cylinders 521, 541, respectively, and dented discharge noise silencing chambers 527, 547. It is to be noted that the discharge noise silencing chambers 527, 547 communicate with discharge ports 529, 549. Openings of these discharge noise silencing chambers 527, 547 are closed by covers, respectively. That is, the discharge noise silencing chamber 527 is closed by an upper cover 528, and the discharge noise silencing chamber 547 is closed by a lower cover 548.

Moreover, an upper bearing 524*a* is vertically formed in a middle of the upper support member 525, and a lower bearing 544*a* is formed in such a manner as to extend through the middle of the lower support member 545. Moreover, the rotation shaft 504 is supported by the upper bearing 524*a* of the upper support member 525 and the lower bearing 544*a* of the lower support member 545.

Figure 16:
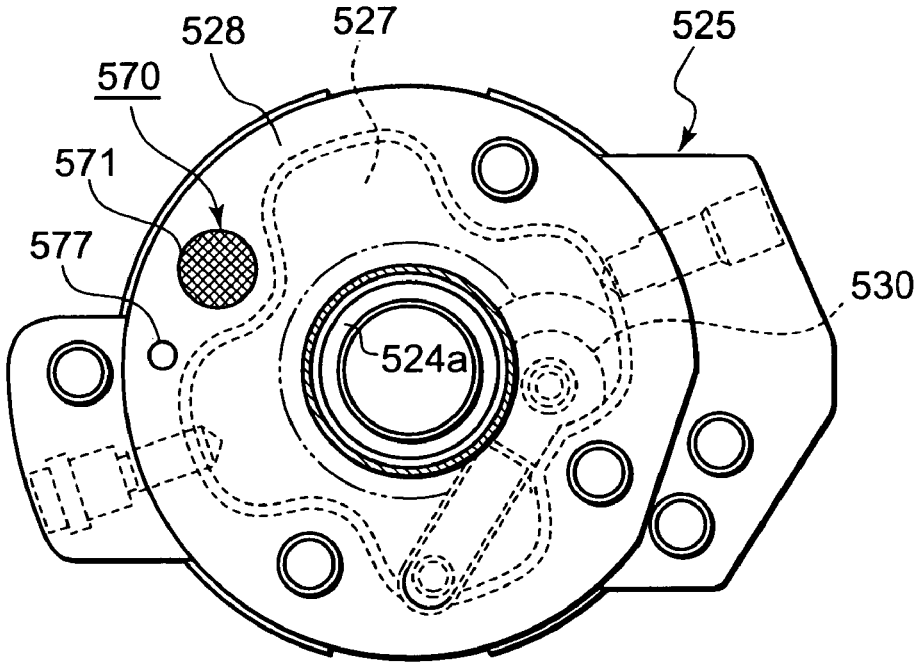
FIG. 16 is an upper surface view of the upper support member and upper cover of the two-stage compression system rotary compressor of FIG. 14.

Furthermore, the upper cover 528 closes the upper surface opening of the discharge noise silencing chamber 527 to partition the airtight container 502 into a discharge noise silencing chamber 527 side and an electric motor 503 side. As shown in FIG. 16, the upper cover 528 is constituted of a substantially donut-shaped circular steel plate in which a hole for passing the upper bearing 524*a* of the upper support member 525 is formed, and a peripheral portion of the upper cover is fixed to the upper support member 525 from above by main bolts 567. Tips of the main bolts 567 engage with the lower support member 545. It is to be noted that, as shown in FIG. 16, a discharge valve 530 of the high stage side compression element 520 for opening/closing the discharge port 529 is disposed in an upper part of the upper support member 525 in a state in which the valve is positioned in the discharge noise silencing chamber 527.

The lower cover 548 is constituted of a donut-shaped circular steel plate, and fixed to the lower support member 545 from below by main bolts 565 in a peripheral portion thereof. It is to be noted that tips of the main bolts 565 engage with the upper support member 525.

Figure 15:
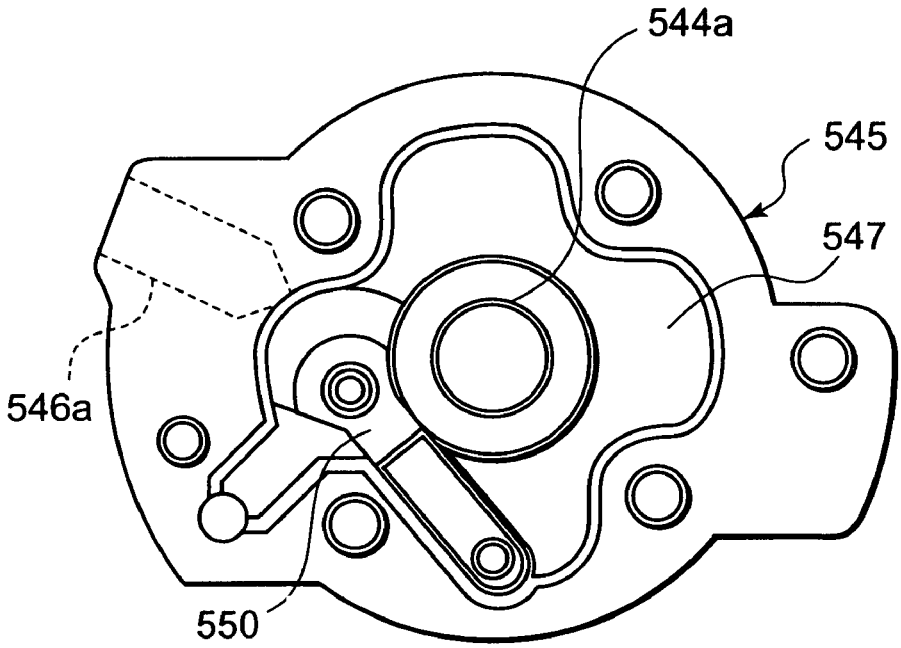
FIG. 15 is a lower surface view of the lower support member of the two-stage compression system rotary compressor of FIG. 14.

As shown in FIG. 15, a discharge valve 550 of the low stage side compression element 540 for opening/closing the discharge port 549 is disposed in a lower surface of the lower support member 545 in a state in which the valve is positioned in the discharge noise silencing chamber 547.

The discharge valves 530, 550 are constituted of elastic members such as vertically long metal plates. The discharge valves 530, 550 are fixed by screws (not shown) on their one-end sides, and are screwed/attached to the upper support member 525 or the lower support member 545 in such a manner as to elastically abut on and close the discharge ports 529, 549 on their other-end sides.

Moreover, the discharge noise silencing chamber 547 is connected to the electric motor 503 side of the upper cover 528 in the airtight container 502 via a communication path (not shown) which is a hole extending through the upper and lower cylinders 521, 541 and the intermediate partition plate 560. Moreover, an intermediate discharge tube 566 is vertically disposed on an upper end of the communication path (not shown), and the intermediate discharge tube 566 is constituted in such a manner as to discharge an intermediate-pressure refrigerant into the airtight container 502 therefrom.

As shown in FIG. 14, a suction piping 551 of the low stage side compression element 540 is connected/attached to the suction passage 546*a* of the lower support member 545. One end of a suction piping 531 of the high stage side compression element 520 is connected into the airtight container 502 on the upper side of the upper cover 528, although not shown. The other end of the suction piping communicates with the suction passage 526*a* of the high stage side compression element 520. A discharge piping 532 of the high stage side compression element is attached in such a manner as to be taken out of the discharge noise silencing chamber 527 of the high stage side compression element 520.

The pressure control valve 570 is disposed in the housing of the rotary compression mechanism section 510 constituted of the intermediate partition plate 560, cylinders 521, 541, upper support member 525, lower support member 545 and the like. The pressure control valve 570 is constituted of a cylinder 571, two upper and lower pistons 572, 573, a rod 574, communication paths 576, 577, 578 and the like.

Figure 19:
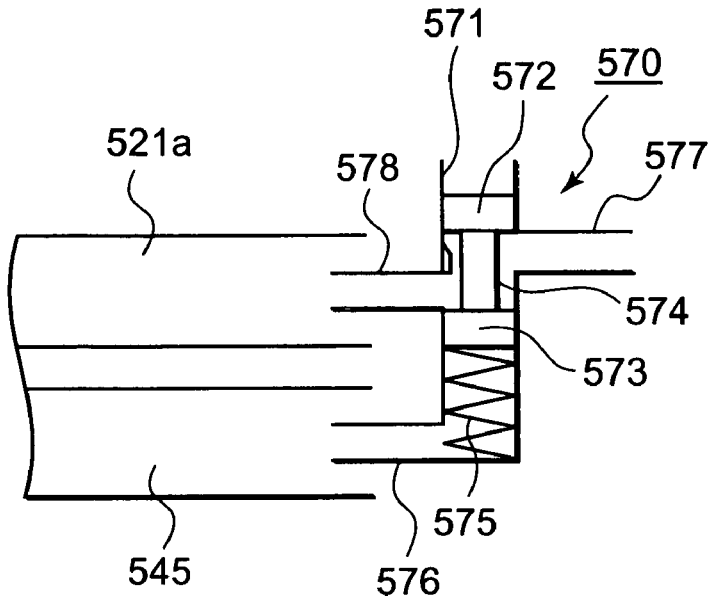
FIG. 19 is a schematic structure diagram of a pressure control valve in the two-stage compression system rotary compressor of FIG. 14, showing a state in which an intermediate pressure is lower than a predetermined value.
Figure 20:
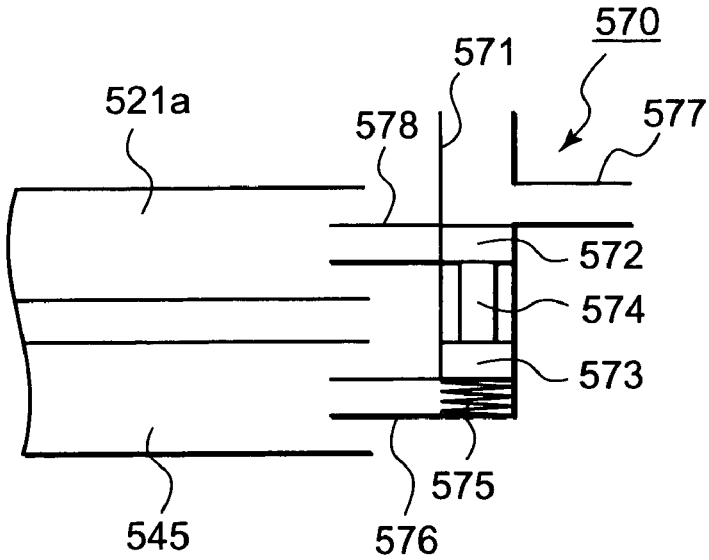
FIG. 20 is a schematic structure diagram of the pressure control valve in the two-stage compression system rotary compressor of FIG. 14, showing a state in which the intermediate pressure exceeds the predetermined value.

As seen from FIGS. 14, 19, 20, the cylinder 571 extends through the upper surface of the upper support member 525 from the lower cylinder 541 of the rotary compression mechanism section 510, and an upper surface thereof opens into the airtight container 502. The pistons 572, 573 are slidably housed in the cylinder 571, and are constituted in such a manner that an intermediate pressure by the gas refrigerant in the airtight container introduced from an opening (see FIG. 16) of the cylinder upper surface is applied to the upper surface of the upper piston. A spring 575 is disposed under the lower piston 573, and is set in such a manner that the piston 573 is pushed upwards from below with a predetermined force. In the communication path 576, a portion of the cylinder 571 in which the spring 575 is disposed is connected to the suction passage 546*a* of the low stage side compression element 540.

By this constitution, a resultant force of an elastic force of the spring 575 from below and a low pressure by the refrigerant drawn in the low stage side compression element 540 is applied to the pistons 572, 573, and an intermediate pressure by the gas refrigerant in the airtight container 502 is applied from above. Moreover, the elastic force is set in such a manner that the spring 575 pushes upwards the pistons 572, 573 to predetermined positions, when the intermediate pressure lowers to a predetermined pressure. The pistons 572, 573 are pushed downwards to predetermined positions, when the intermediate pressure exceeds the predetermined pressure and rises.

As shown in FIGS. 19 and 20, when the pistons 573, 574 move to the predetermined upper positions, the communication path 577 connects the airtight container 502 to a portion between both the pistons 573, 574 in the cylinder 571. The communication path opens into an upper surface position of the upper piston 572 in the cylinder 571, when the pistons 573, 574 move to the predetermined lower positions.

As shown in FIGS. 19 and 20, when the pistons 573, 574 move to the predetermined upper positions, the communication path 578 connects an in-cylinder compression chamber 521*a* of the high stage side compression element 520 to a portion between both the pistons 573, 574 in the cylinder 571. The communication path is formed in such a manner that an opening into the cylinder 571 is closed by the side surface of the upper piston 572, when the pistons 573, 574 move to the predetermined lower positions.

Figure 21:
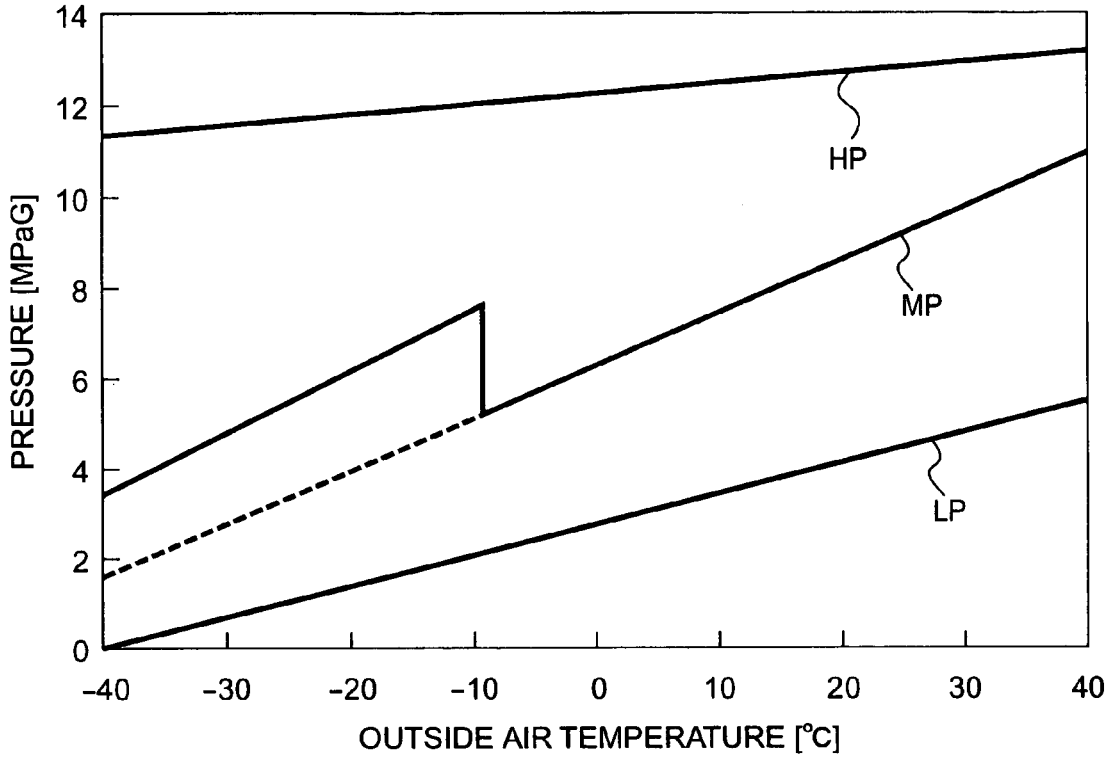
FIG. 21 is an explanatory view of an intermediate pressure control by the pressure control valve of the two-stage compression system rotary compressor of FIG. 14.

For example, it is assumed that the two-stage compression system rotary compressor 501 is used in a heat pump type water heater and that the two-stage compression system rotary compressor 501 indicates a pressure characteristic graph shown in FIG. 21. In this case, when outside air is at −10° C., in the two-stage compression system rotary compressor 501, an intermediate pressure is about 5 MPaG, a discharge pressure is about 12 MPaG, and a low pressure is 2 MPaG. The elastic force of the spring 575 is set in such a manner that the pistons 572, 573 move to the predetermined upper positions and the operation is performed with a saved power.

Figure 18:
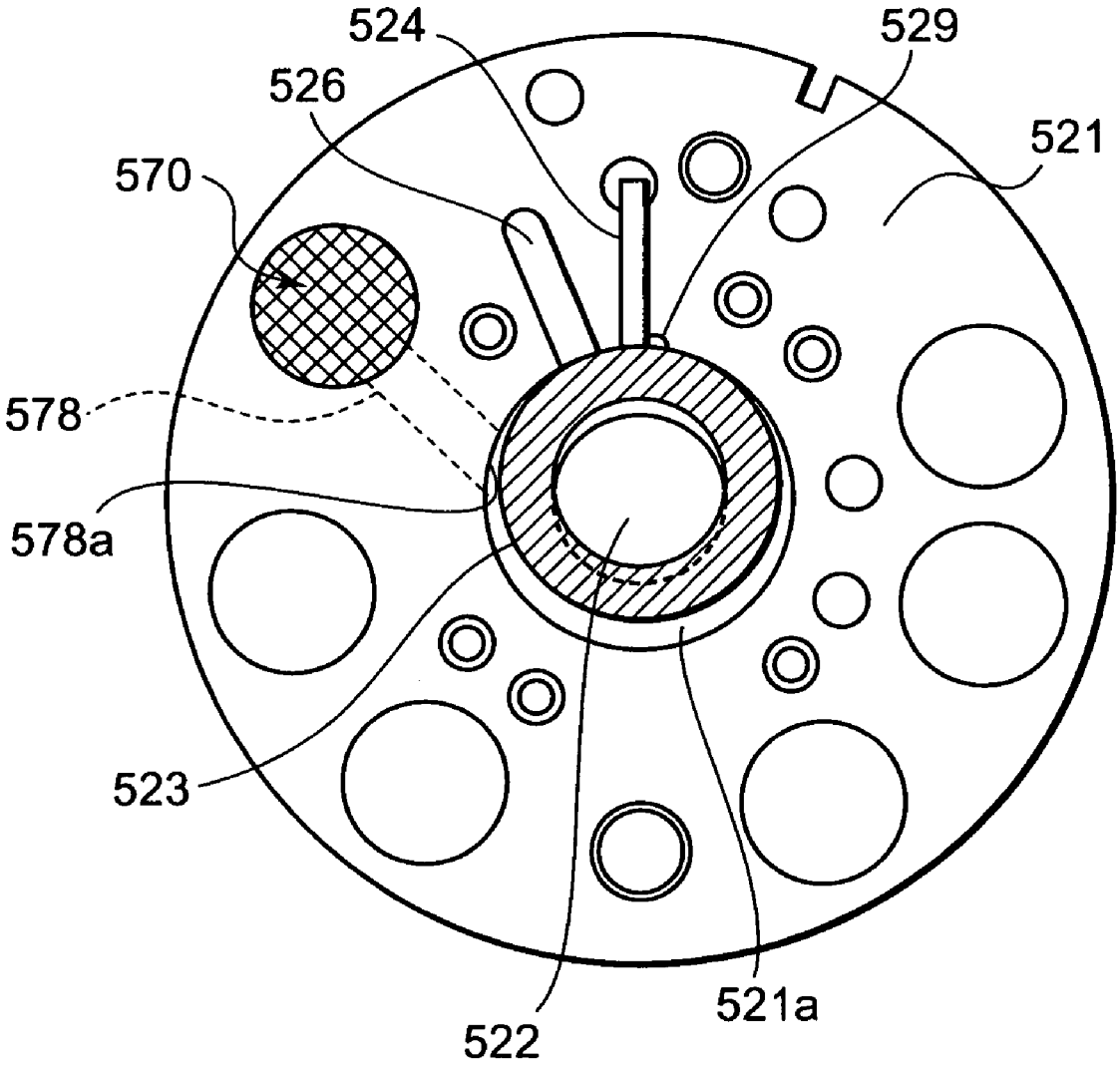
FIG. 18 is an upper surface view of the upper cylinder of the two-stage compression system rotary compressor of FIG. 14.

Moreover, as shown in FIG. 18, an opening position of the communication path 578 into the compression chamber 521*a* is set to an appropriate position extending to the discharge port 529 from the suction port 526 in the compression chamber 521*a* in the low stage side compression element 540. It is to be noted that a compressed refrigerant amount in the high stage side compression element at the time of a power saving operation described later is set by the position.

Furthermore, in the two-stage compression system rotary compressor 501, carbon dioxide ($CO_2$) described above, which is an ecologically friendly natural refrigerant, is used as the refrigerant in consideration of flammability, toxicity and the like. Existing oils such as mineral oil, alkyl benzene oil, ether oil, and ester oil are used as lubricant oils.

An operation of the two-stage compression system rotary compressor 501 according to the embodiment constituted as described above will be described. First, a basic operation mode will be described. The stator coil 506*b* of the electric motor 503 is energized via the terminal 505 and a wiring (not shown). When the stator coil 506*b* is energized, the electric motor 503 starts, and the rotor 507 rotates. By the rotation of the rotor 507, the upper and lower eccentric portions 522, 542 in the high stage side compression element 520 and low stage side compression element 540 disposed integrally with the rotation shaft 504 rotate, and the upper and lower rollers 523, 543 fitted into the upper and lower eccentric portions 522, 542 eccentrically rotate in the upper and lower cylinders 521, 541.

Figure 17:
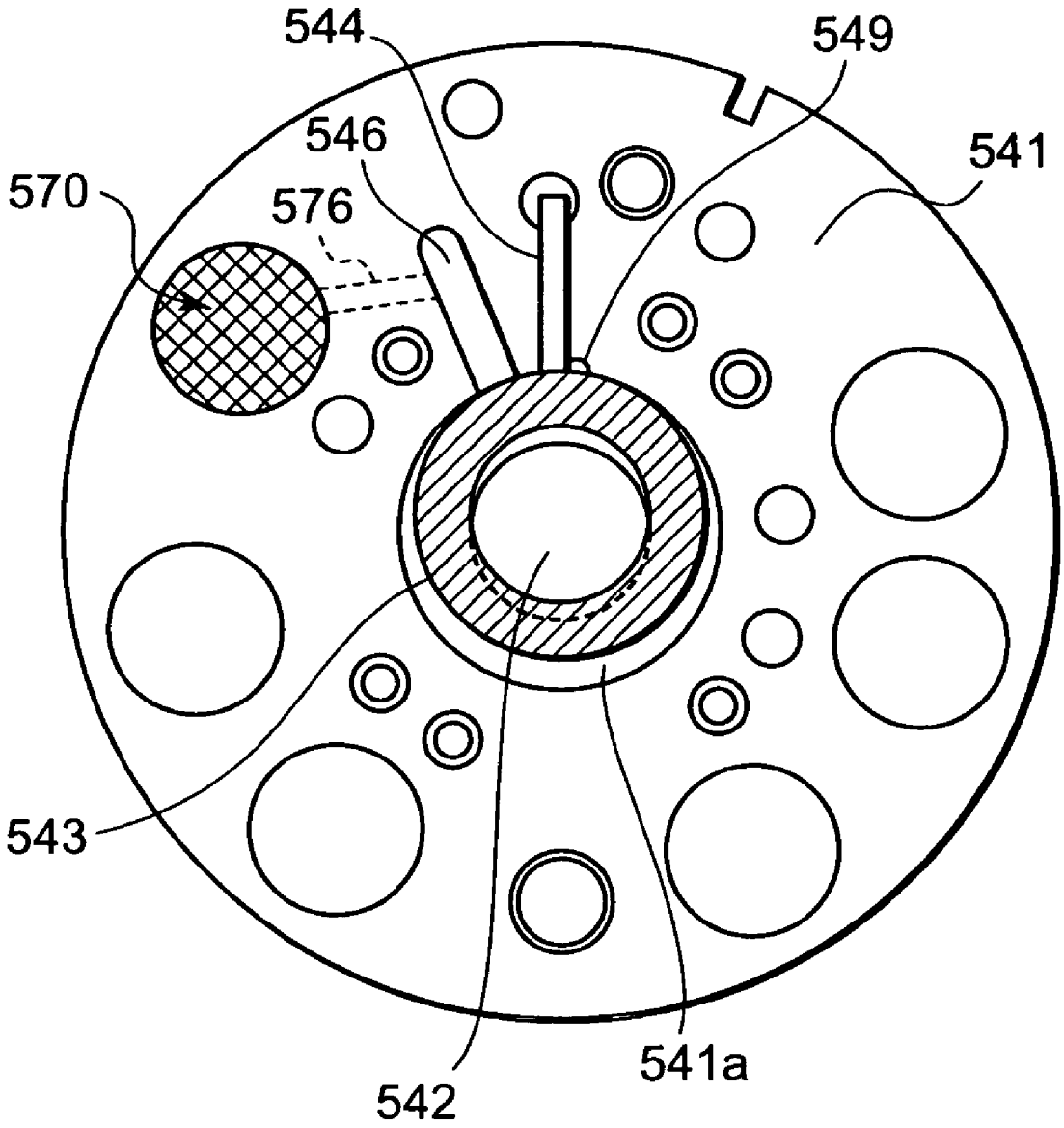
FIG. 17 is a lower surface view of the lower cylinder of the two-stage compression system rotary compressor of FIG. 14.

Accordingly, in the low stage side compression element 540, the refrigerant in a refrigerant circuit connected to the outside is drawn in a compression chamber 541*a* of the lower cylinder 541 on the low pressure chamber side via the suction piping 551, and the suction passage 546*a* formed in the lower support member 545 and further via a suction port 546 shown in a lower surface view of the lower cylinder 541 in FIG. 17. A low-pressure (LP) refrigerant drawn in the compression chamber 541*a* is compressed by the operation of the lower roller 543 and the lower vane 544 to obtain an intermediate pressure (MP), and discharged into the discharge noise silencing chamber 547 formed in the lower support member 545 from the lower cylinder 541 on the high pressure chamber side via the discharge port 549.

The gas refrigerant having the intermediate pressure discharged into the discharge noise silencing chamber 547 is discharged into the airtight container 502 from the intermediate discharge tube 566 via a communication path (not shown), and accordingly the inside of the airtight container 502 obtains the intermediate pressure.

The gas refrigerant having the intermediate pressure in the airtight container 502 is passed through the suction piping 531, drawn in the high stage side compression element 520, and compressed in the second stage. That is, the intermediate-pressure gas refrigerant is drawn in the compression chamber 521*a* of the upper cylinder 521 on the low pressure chamber side from the suction port 526 shown in an upper surface view of the upper cylinder 521 in FIG. 18 via the suction passage 526*a* formed in the upper support member 525. The drawn-in intermediate-pressure gas refrigerant is compressed in the second stage by the operation of the upper roller 523 and the upper vane 524 to constitute a gas refrigerant having a high temperature and pressure (HP), and is discharged from the high pressure chamber side via the discharge port 529. The discharged refrigerant in the high stage side compression element 520 is circulated in a refrigerant circuit (not shown) disposed outside the two-stage compression system rotary compressor 501 from the discharge noise silencing chamber 527 formed in the upper support member 525 via the discharge piping 532, and drawn in a low stage side compression element 540 side again.

The two-stage compression system rotary compressor 501 according to the present embodiment is used in a heat pump type water heater, and has operation characteristics shown in FIG. 21 at the time of a water heating operation. In this case, when the temperature of the outside air exceeds −10° C., the operation is performed in the basic operation mode. In the operation characteristics of FIG. 21, when the outside air is at −10° C. or more, a high pressure side pressure HP is 12 MPaG or more, an intermediate pressure MP is 5 MPaG or more, a low pressure side pressure LP is 4 MPaG or more, and a high/low pressure difference of the high stage side compression element 520 is 7 MPaG or less. Therefore, in the two-stage compression system rotary compressor 501, when the intermediate pressure indicates a predetermined value (5 MPaG in this case) or more, the intermediate pressure (MP) in the airtight container 502 applied to the pistons 572, 573 in a downward direction from above is set to be larger than a resultant force of the elastic force of the spring 575 applied to the pistons 572, 573 in an upward direction from below and the low pressure side pressure guided from the communication path 576.

By this setting, in the two-stage compression system rotary compressor 501, when the outside air is at −10° C. or more (i.e., the intermediate pressure is 5 MPaG or more), the pistons 572, 573 are position in the predetermined lower positions, and the communication path 578 is closed. Therefore, in this state, the airtight container 502 is not directly connected to the compression chamber 521*a* in the high stage side compression element 520 via the communication paths 577 and 578, and the above-described basic operation mode is performed.

However, when the outside air is at −10° C. or less (i.e., the intermediate pressure is 5 MPaG or less), the resultant force applied to the lower surface of the lower piston 573 is larger than the intermediate pressure of the airtight container 502 applied to the upper surface of the piston 572, and the pistons 572, 573 move to the predetermined upper positions. As a result, the airtight container 502 is directly connected to the compression chamber 521*a* of the high stage side compression element 520 via the communication path 577, cylinder 571, and communication path 578.

Therefore, in the high stage side compression element 520, even when the contact point between the upper roller 523 and the cylinder 521 goes beyond the suction port 526, a compression function is not performed on a rotation front side of the contact point until the contact point goes beyond an opening 578*a* (see FIG. 18) of the communication path 578. This means that a cylinder volume is substantially decreased. Therefore, a suction amount in the high stage side compression element 520 decreases, and the intermediate pressure moves to an upper solid line with respect to a conventional dotted line in FIG. 21. Accordingly, the high/low pressure difference in the high stage side compression element 520 can be decreased as compared with conventional characteristics. This is referred to as the power saving operation.

Figure 22:
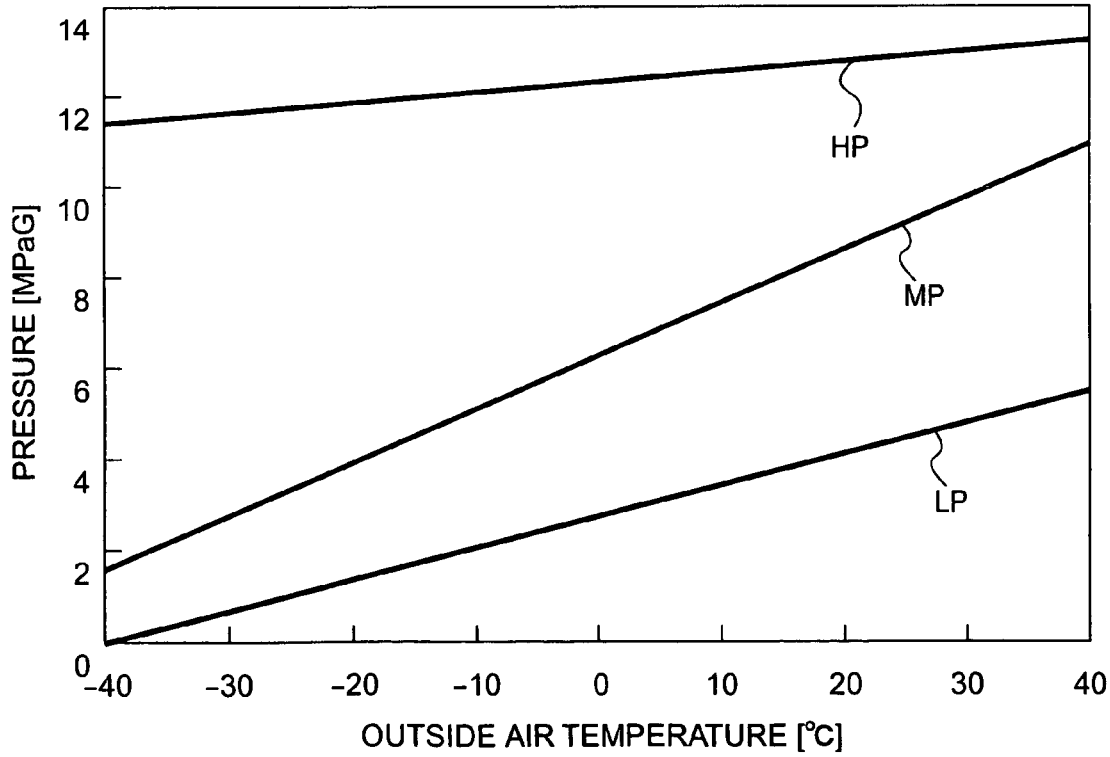
FIG. 22 is a general characteristic graph showing a relation between an outside air temperature and a high/low/intermediate pressure in a case where the two-stage compression system rotary compressor of FIG. 14 is applied to a heat pump type water heater.

Here, in the heat pump type water heater using the two-stage compression system rotary compressor using carbon dioxide ($CO_2$) which is a refrigerant having a large high/low pressure difference, when a suction volume of the first stage (lower stage side) and that of the second stage (high stage side) are constant at a ratio of approximately 2:1, a compression ratio of the first stage is approximately 2, and characteristics shown in FIG. 22 are generally indicated. In this device, in a region of the outside air at +10° C. or more, the discharge pressure (i.e., high pressure side pressure) HP of the high stage side compression element is about 12 MPaG or more, the suction pressure of the high stage side compression element, that is, the discharge pressure of the low stage side compression element is an intermediate pressure MP of 8 MPaG or more, and the suction pressure (i.e., the low pressure side pressure) LP of the low stage side compression element is 4 MPaG or more. Therefore, the high/low pressure difference (difference between the discharge pressure HP of the high stage side compression element and the suction pressure MP of the high stage side compression element) of the high stage side compression element in the two-stage compression system rotary compressor using carbon dioxide ($CO_2$) as the refrigerant is 4 MPaG, and a pressure difference on the low stage side is equal to that on the high stage side. However, in the two-stage compression system rotary compressor, since a compression ratio is substantially constant, the lower the outside air temperature is, the lower the discharge pressure MP of the low stage side compression element becomes. Therefore, the high/low pressure difference of the high stage side compression element is further increased.

However, as described above, in the present invention, since the suction amount in the high stage side compression element 520 decreases, and the intermediate pressure moves to an upper solid line with respect to a conventional dotted line (solid line in FIG. 22) shown in FIG. 21, the problem is solved.

In the two-stage compression system rotary compressor according to the present embodiment, as described above, since the pressure control valve 570 for performing the power saving operation is housed in the housing constituting the rotary compression mechanism section 510, in a freezer apparatus using the two-stage compression system rotary compressor 501, a bypass circuit, electromagnetic opening/closing valve, or pressure detection device are not required in the refrigerant circuit unlike the conventional apparatus, and the apparatus is simplified.

Moreover, by the pressure control valve 570, the resultant force of the elastic force of the spring 575 and the low pressure side pressure, and the gas refrigerant pressure in the airtight container 502 are applied in a facing manner with respect to the pistons 572, 573 slidably housed in the cylinder 571. When the discharge pressure of the low stage side compression element 540 drops to a predetermined value or less, the pistons 572, 573 are moved in one direction (predetermined upper positions in this case) in the cylinder 571 by the resultant force against the intermediate pressure. Accordingly, the gas refrigerant in the airtight container 502 can be introduced into the cylinder 521 of the high stage side compression element 520. When the discharge pressure of the low stage side compression element 540 exceeds the predetermined value and rises, the pistons 572, 573 are moved in the other direction (predetermined lower positions in this case) by the gas refrigerant in the airtight container 502 against the resultant force to interrupt the introduction of the gas refrigerant in the airtight container 502 into the cylinder 521. Therefore, only the spring 575 is used as a driving mechanism, and a structure of pressure adjustment means can be simplified.

It is to be noted that in the present embodiment, the electric motor 503 is constituted in such a manner that the rotation number can be controlled. Therefore, when the rotation number of the electric motor 503 is controlled, a capability of the two-stage compression system rotary compressor 501 can be controlled. When the rotation number of the electric motor 503 is controlled in this manner to control the compression capability, the intermediate pressure also changes. Even in this case, the pressure control valve 570 operates, and the intermediate pressure can be adjusted.

Therefore, when the two-stage compression system rotary compressor 501 of the present embodiment is used in a car cooler or a heat pump type water heater, it is possible to operate the compressor safely at the outside air temperature that changes in a broad range.

As described above, in this case, the pressure in the airtight container is set to an intermediate pressure in the rotary compressor of the present invention. When the discharge pressure of the low stage side compression element drops to the predetermined value or less, the gas refrigerant in the airtight container is introduced into the cylinder of the high stage side compression element. When the discharge pressure of the low stage side compression element exceeds the predetermined value and rises, the introduction of the gas refrigerant in the airtight container into the cylinder. The pressure control valve constituted in this manner is housed in the housing constituting the rotary compression mechanism section. Therefore, in the freezer apparatus using the two-stage compression system rotary compressor, unlike the conventional apparatus, the bypass circuit, electromagnetic opening/closing valve, or pressure detection device is not required. The freezer apparatus using the two-stage compression system rotary compressor can be simplified and miniaturized. It is to be noted that in the above-described constitution, when it is possible to control the rotation of the electric motor, the capability can be adjusted.

Moreover, the pressure control valve is constituted of the piston and the cylinder in which the piston is slidably housed. Moreover, the resultant force of the low pressure side pressure and the elastic force of the spring, and the gas refrigerant pressure in the airtight container are applied in the facing manner with respect to the piston. When the discharge pressure of the low stage side compression element drops to the predetermined value or less, the piston is moved in one direction in the cylinder by the resultant force in such a manner that the gas refrigerant in the airtight container can be introduced into the cylinder of the high stage side compression element. When the discharge pressure of the low stage side compression element exceeds the predetermined value and rises, the piston is moved in the other direction by the gas refrigerant pressure in the airtight container against the resultant force in such a manner as to interrupt the introduction of the gas refrigerant in the airtight container into the cylinder. When the pressure control valve is constituted in such a manner as to realize this operation, the structure of the pressure control valve can be simplified because only the spring is used as the driving mechanism of the pressure control valve.

Furthermore, in the car air conditioner according to the present invention, a carbon dioxide gas is used as the refrigerant gas, the two-stage compression system rotary compressor is used, and therefore a heating operation is possible against any change of the outside air temperature in a broad range.

Additionally, in a water heater air conditioner according to the present invention, a carbon dioxide gas is used as the refrigerant gas, the two-stage compression system rotary compressor is used, therefore high-temperature water can be supplied, and a water heating operation is possible against any change of the outside air temperature in a broad range.

What is claimed is:

1. A vertical rotary compressor, comprising:

an airtight container housing a driving element and a rotary compression mechanism section driven by the driving element; and oil separation means, disposed in the airtight container, for centrifugally separating oil in a refrigerant which has been compressed by the rotary compression mechanism section and discharged, wherein the oil separation means is disposed between the rotary compression mechanism section and an outer wall of the airtight container, and abuts an inner surface of the outer wall of the airtight container and abuts a support member of the rotary compression mechanism section.

2. The rotary compressor according to claim 1, wherein the oil separation means is disposed in the vicinity of the rotary compression mechanism section in a space between the airtight container and the rotary compression mechanism section.

3. A vertical rotary compressor, comprising:

an airtight container housing a driving element and a rotary compression mechanism section driven by the driving element; and an oil separator, disposed in the airtight container, for centrifugally separating oil in a refrigerant which has been compressed by the rotary compression mechanism section and discharged, wherein the oil separator is disposed between the rotary compression mechanism section and an outer wall of the airtight container, and abuts an inner surface of the outer wall of the airtight container and abuts a support member of the rotary compression mechanism section.

4. A vertical rotary compressor, comprising:

an airtight container housing a driving element and a rotary compression mechanism section driven by the driving element; and oil separation means, disposed in the airtight container, for centrifugally separating oil in a refrigerant which has been compressed by the rotary compression mechanism section and discharged, wherein the oil separation means includes an inner space and a communication tube that connects the inner space and a discharge tube, and refrigerant gas and oil discharged from the rotary compression mechanism section are discharged to an outer wall surface of the communication tube, and the refrigerant gas and oil are turned around in a spiral form in a gap formed between an outer wall surface of the communication tube and an inner surface of the inner space to centrifugally separate oil mixed in the refrigerant gas, wherein the oil separation means is disposed between the rotary compression mechanism section and an outer wall of the airtight container, and abuts an inner surface of the outer wall of the airtight container and abuts a support member of the rotary compression mechanism section.

5. The rotary compressor according to claim 4, wherein the oil separation means is disposed in the vicinity of the rotary compression mechanism section in a space between the airtight container and the rotary compression mechanism section.

* * * * *